US008205884B2

(12) United States Patent
Schubert et al.

(10) Patent No.: US 8,205,884 B2
(45) Date of Patent: Jun. 26, 2012

(54) INTELLIGENT BACCARAT SHOE

(75) Inventors: Oliver M. Schubert, Las Vegas, NV (US); Joshua David Marz, Henderson, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 13/110,828

(22) Filed: May 18, 2011

(65) Prior Publication Data

US 2011/0227283 A1 Sep. 22, 2011

Related U.S. Application Data

(60) Continuation of application No. 11/897,637, filed on Aug. 31, 2007, now Pat. No. 7,950,663, which is a division of application No. 10/915,914, filed on Aug. 10, 2004, now Pat. No. 7,264,241, which is a continuation-in-part of application No. 10/622,321, filed on Jul. 17, 2003, now Pat. No. 7,029,009, and a continuation-in-part of application No. 10/880,408, filed on Jun. 28, 2004, now abandoned.

(51) Int. Cl.
*A63F 1/14* (2006.01)

(52) U.S. Cl. ..... 273/143 R

(58) Field of Classification Search ..... 273/149 R, 273/149 P

See application file for complete search history.

(56) References Cited

U.S. PATENT DOCUMENTS

| | | | |
|---|---|---|---|
| 1,831,580 | A | 11/1931 | Stecker |
| 2,395,138 | A | 2/1946 | Nichols |
| 3,222,071 | A | 12/1965 | Lang |
| 3,929,339 | A | 12/1975 | Mattioli |
| 4,457,512 | A | 7/1984 | Stevenson |
| 4,494,197 | A | 1/1985 | Troy et al. |
| 4,497,488 | A | 2/1985 | Plevyak et al. |
| 4,534,562 | A | 8/1985 | Cuff et al. |
| 4,667,959 | A | 5/1987 | Pfeiffer et al. |
| 4,750,743 | A | 6/1988 | Nicoletti |
| 4,755,941 | A | 7/1988 | Bacchi |
| 4,926,327 | A | 5/1990 | Sidley |
| 4,995,615 | A | 2/1991 | Cheng |
| 5,179,517 | A | 1/1993 | Sarbin et al. |
| 5,199,710 | A | 4/1993 | Lamle |
| 5,209,476 | A | 5/1993 | Eiba |

(Continued)

FOREIGN PATENT DOCUMENTS

CN 101127131 2/2008

(Continued)

OTHER PUBLICATIONS

Press Release for Alliance Gaming Corp., Jul. 26, 2004—Alliance Gaming Announces Contract With Galaxy Macau for New MindPlay Baccarat Table Technology, http://biz.yahoo.com/prnews.

(Continued)

*Primary Examiner* — Benjamin Layno

(74) *Attorney, Agent, or Firm* — TraskBritt

(57) ABSTRACT

A method of controlling a game of Baccarat, the method including the steps of providing a card delivery shoe equipped with a sensor capable of reading at least a rank of each card; a first processor capable of controlling operation of the card delivery shoe; and a second processor capable of receiving signals from the sensor and programmed to display information related to the game of Baccarat.

7 Claims, 4 Drawing Sheets

U.S. PATENT DOCUMENTS 5,224,712 A 7/1993 Laughlin et al.
5,257,179 A 10/1993 DeMar
5,276,312 A 1/1994 McCarthy
5,283,422 A 2/1994 Storch et al.
5,356,145 A 10/1994 Verschoor
5,362,053 A 11/1994 Miller
5,364,104 A 11/1994 Jones et al.
5,374,061 A 12/1994 Albrecht
5,393,067 A 2/1995 Paulsen et al.
5,431,399 A 7/1995 Kelley
5,470,079 A 11/1995 LeStrange et al.
5,544,893 A 8/1996 Jones et al.
5,586,766 A 12/1996 Forte et al.
5,586,936 A 12/1996 Bennett et al.
5,605,334 A 2/1997 McCrea, Jr.
5,613,912 A 3/1997 Slater
5,655,961 A 8/1997 Acres et al.
5,669,816 A 9/1997 Garczynski et al.
5,681,039 A 10/1997 Miller
5,722,893 A 3/1998 Hill et al.
5,735,525 A 4/1998 McCrea, Jr.
5,770,533 A 6/1998 Franchi
5,772,505 A 6/1998 Garczynski et al.
5,779,546 A 7/1998 Meissner et al.
5,781,647 A 7/1998 Fishbine et al.
5,788,574 A 8/1998 Ornstein et al.
5,803,808 A 9/1998 Strisower
5,911,626 A 6/1999 McCrea, Jr.
5,919,090 A 7/1999 Mothwurf
5,932,139 A 8/1999 Oshima et al.
5,941,769 A 8/1999 Order
5,989,122 A 11/1999 Roblejo
6,039,650 A 3/2000 Hill
6,071,190 A 6/2000 Weiss et al.
6,093,103 A 7/2000 McCrea, Jr.
6,117,012 A 9/2000 McCrea, Jr.
6,126,166 A 10/2000 Lorson et al.
6,139,014 A 10/2000 Breeding et al.
6,165,069 A 12/2000 Sines et al.
6,217,447 B1 4/2001 Lofink et al.
6,250,632 B1 6/2001 Albrecht
6,267,248 B1 7/2001 Johnson et al.
6,267,671 B1 7/2001 Hogan
6,270,404 B2 8/2001 Sines et al.
6,293,864 B1 9/2001 Romero
6,299,536 B1 10/2001 Hill
6,313,871 B1 11/2001 Schubert
6,346,044 B1 2/2002 McCrea, Jr.
6,361,044 B1 3/2002 Block et al.
6,403,908 B2 6/2002 Stardust et al.
6,443,839 B2 9/2002 Stockdale et al.
6,446,864 B1 9/2002 Kim et al.
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,532,297 B1 3/2003 Lindquist
6,533,276 B2 3/2003 Soltys et al.
6,533,662 B2 3/2003 Soltys et al.
6,579,180 B2 6/2003 Soltys et al.
6,579,181 B2 6/2003 Soltys et al.
6,582,301 B2 * 6/2003 Hill ..... 463/11
6,582,302 B2 6/2003 Romero
6,585,586 B1 7/2003 Romero
6,588,751 B1 7/2003 Grauzer et al.
6,595,857 B2 7/2003 Soltys et al.
6,616,535 B1 9/2003 Nishizaki et al.
6,622,185 B1 9/2003 Johnson et al.
6,629,889 B2 10/2003 Mothwurf
6,629,894 B1 * 10/2003 Purton ..... 463/47
6,637,622 B1 10/2003 Robinson
6,638,161 B2 10/2003 Soltys et al.
6,645,068 B1 11/2003 Kelly et al.
6,645,077 B2 11/2003 Rowe
6,652,379 B2 11/2003 Soltys et al.
6,663,490 B2 12/2003 Soltys et al.
6,666,768 B1 12/2003 Akers
6,685,567 B2 2/2004 Cockerille et al.
6,685,568 B2 2/2004 Soltys et al.
6,688,979 B2 2/2004 Soltys et al.
6,698,756 B1 3/2004 Baker et al.
6,712,696 B2 3/2004 Soltys et al.
6,719,634 B2 4/2004 Mishina et al.
6,746,333 B1 6/2004 Onda et al.
6,758,751 B2 7/2004 Soltys et al.
6,758,757 B2 7/2004 Luciano, Jr. et al.
6,804,763 B1 10/2004 Stockdale et al.
7,124,947 B2 10/2006 Storch
7,261,294 B2 8/2007 Grauzer et al.
7,278,917 B2 10/2007 McGlone et al.
7,322,576 B2 1/2008 Grauzer et al.
7,351,147 B2 4/2008 Stockdale et al.
7,369,161 B2 5/2008 Easwar et al.
7,407,438 B2 8/2008 Schubert et al.
7,593,544 B2 9/2009 Downs, III et al.
7,699,694 B2 4/2010 Hill
7,769,232 B2 8/2010 Downs, III
7,933,444 B2 4/2011 Downs, III et al.
2003/0195025 A1 10/2003 Hill
2004/0003395 A1 1/2004 Srinivas et al.
2004/0116179 A1 6/2004 Nicely et al.
2005/0026680 A1 2/2005 Gururajan
2005/0082750 A1 4/2005 Grauzer et al.
2005/0119048 A1 6/2005 Soltys et al.
2005/0242500 A1 11/2005 Downs
2006/0063577 A1 3/2006 Downs et al.
2006/0279040 A1 12/2006 Downs, III et al.
2007/0018389 A1 1/2007 Downs, III et al.
2007/0256111 A1 11/2007 Medford et al.
2007/0275762 A1 11/2007 Aaltone et al.
2008/0006998 A1 1/2008 Grauzer et al.
2008/0037628 A1 2/2008 Boyce et al.
2008/0113783 A1 5/2008 Czyzewski et al.
2008/0203658 A1 8/2008 Grauzer et al.

FOREIGN PATENT DOCUMENTS

DE 4439502 6/1995
GB 2395138 5/2004
WO 9943404 9/1999
WO 0051076 8/2000
WO 2008008194 1/2008

OTHER PUBLICATIONS

Tracking the Tables, by Jack Bularsky, Casino Journal, May 2004, vol. 17, No. 5, pp. 44-47.

* cited by examiner

INTELLIGENT BACCARAT SHOE

CROSS-REFERENCE TO RELATED APPLICATIONS

This application is a continuation of U.S. patent application Ser. No. 11/897,637, filed Aug. 31, 2007, now U.S. Pat. No. 7,950,663, issued May 31, 2011, which in turn is a divisional application of U.S. patent application Ser. No. 10/915,914, filed Aug. 10, 2004, now U.S. Pat. No. 7,264,241, issued Sep. 4, 2007, which in turn is a continuation-in-part application of both U.S. patent application Ser. No. 10/622,321, filed Jul. 17, 2003, now U.S. Pat. No. 7,029,009, issued Apr. 18, 2006, and U.S. patent application Ser. No. 10/880,408, filed Jun. 28, 2004, now abandoned.

BACKGROUND OF THE INVENTION

1. Field of the Invention

The present invention relates to the field of gaming, the field of casino table card gaming, the play of Baccarat at a casino card table, and the use of equipment with processing capability in the play of Baccarat.

2. Background of the Art

One game that is extremely popular in casinos throughout the world is Baccarat. This game is easy to play, but is difficult and costly to administer. One table is commonly attended by up to three casino personnel, regardless of the number of players. In addition, because the stakes are typically very high, credit managers and security personnel remain in close proximity to the table at all times. Casinos throughout the United States have Baccarat tables, and many of these tables are high stakes tables. It is not unusual to observe players wagering large amounts in each round of play.

The game of Baccarat is fairly simple to play from the player's perspective. The player is not given any opportunity to make decisions that would have an impact on the outcome of the game. The game is typically played with eight standard decks of 52 cards each, and the cards are typically shuffled and wrapped in the back end of the casino, out of the player's view. The cards are commonly destroyed or damaged by players during play, and it is typical for the casino to use the cards only once.

The object of the game is to have the highest total point hand, the highest hand being a natural (a two-card) 9. In scoring the hands, all face value cards and ten value cards have a point value of 10, and Aces have a point value of 11. The card point values are summed, and the tens column of the total count is ignored. For example, a hand of a 6 and a 7 would be counted as a 3, and the rules would require that another card be dealt. If the third card were an 11, the final count of the hand would be a 4 (6 plus 7 plus 11 is 24, and by ignoring the tens column, the final count would be 4).

In order to participate in the game, the player may make one or more wagers, up to the house limit on up to three bets. The player may bet on the player hand, the banker hand, a tie hand or combinations of the above. Players do not typically bet on both the player and dealer hand because this combination gives the house a distinct advantage.

Bets on the player hand pay even money, and bets on the Banker hand pay even money minus a commission, which is typically five percent of the amount won. No commissions are paid on amounts wagered and then lost. The tie bet pays 8:1. If the player and banker hands tie, the wagers on these hands are a push.

Players are permitted to remove cards from a dealing shoe that the dealer passes to a player. If the player places a wager on the Banker's hand, the cards the player removes are used in the Banker hand. All players betting on the player hand play with the same cards. That is, no players receive their own cards. Only the designated player removes cards from the shoe. The dealer then takes the player cards and moves them to a common card area where the hands are set and further dealing decisions are made.

Either the players take turns removing cards from the shoe, or each player takes an alternating turn with the dealer. For example, if there are players in positions 1, 2 and 3, and the dealer is position 4, the cards may be removed by players 1, 2, 3 and then dealer 4, or by 1, 4, 2, 4, and then 3, 4. The house rules typically determine who is allowed to remove cards from the shoe and the order of selection of players permitted to remove cards from the shoe.

The player and banker receive two cards each, face down. The player may view his cards at this time, and this is when the cards are typically damaged by the players. The Banker sets the two hands in a designated area viewable by all players. The player hand is resolved first. If the player hand has a point value of 5 or less, the Banker deals an additional card to the player hand. Only one extra card is permitted, and the Banker/dealer determines if the card should be dealt.

The rules for when the banker takes an additional card are more complicated. If the banker's hand is a zero, 1 or 2, the banker draws a card. If the banker's hand is higher than a 2, then the banker must consider the player's draw card to determine if the banker draws.

If the banker has a hand of 3 points, he draws unless the player's draw card is an 8. This rule is referred to as the "38 special" rule. If the banker has a hand of 4 points, the banker draws if the player's draw card is a 2-7. This rule is referred to as the "27" rule. If the banker has a point value of 5, then the banker draws only if the player has a draw card value of 4-7. This is called the "47" rule. If the banker has a point value of 6, then the banker draws only if the player's draw card is a 6 or a 7. This is referred to as the "67" rule. If the banker has a point value of 7, he does not draw. If the banker has an 8 or a 9, both referred to as a "natural," the hand is over. If the player happens to hold a natural 8 and the banker has a natural 9, the banker hand outranks the player hand and the banker hand wins. If both the player and banker each have a natural 8 or 9, the hand is a push.

According to the game of Baccarat, the dealer executes all of the rules, and the player's wins and losses are based completely on luck, unless there is dealer error. As mentioned earlier, the house takes a commission on the winnings only from the Banker's hand. The payment of commissions can be handled a number of ways. One common way is to provide a square on the layout corresponding to each player position. The dealer drops a token on the square corresponding to the player who just won the banker bet, and this provides an indication that the player owes the house the commission. Other house rules require the dealer to remove the commission from the payout as the payouts are made. Other houses provide commission areas on the table surface where players can place betting chips and the house removes commissions from the store of betting chips placed on the commission areas.

Baccarat has great appeal to Asian gamblers. One rule of etiquette followed by Asian players when playing Baccarat is to never bet against the most elderly player at the table. If the most elderly player bets on the banker's hand, all other players at the table either bet on the same hand or they do not play. Betting against the most elderly player is viewed as being disrespectful to that player and bad luck.

The rules that the banker must follow in resolving hands in Baccarat are fairly complicated, and the dealers can make errors, resulting in inadvertently overpaying players. In addition, the players handle cards and the wagers are located in close proximity to the player's hands, making it easier for a player to slip in extra betting chips, for example, when the player hand is particularly good, or remove chips when the player's hand is poor. Surveillance systems may not be in place or may be inadequate to monitor all the activities taking place at the table.

Dealers might also collude with players in order to cheat the house. Because the stakes are typically very high, any cheating and/or errors in operating the game can have a very large impact on the casino's revenue. For this reason, it would be desirable to have a system that could automatically monitor the play of Baccarat, and have the capability of alerting the house to dealer errors, cheating and the like in real time. The prior art describes a number of game play monitoring devices and systems that are used to monitor activity on a live gaming table. The following is a summary of known devices and systems.

Cards are ordinarily provided to players in casino table card games, either directly from a deck held in the dealer's hands or with cards removed by the dealer from a dealing shoe, dealing rack or directly from a card shuffler. The original dealing racks were little more than trays that supported the deck(s) of cards and allowed the dealer to remove the front card (with its back facing up to hide the rank of the card) and deliver it to a player. Over the years, both stylistic and functional changes have been made to dealing shoes, which have been used for blackjack, poker, Baccarat and other casino table card games.

U.S. Pat. Nos. 6,585,586; 6,582,302; and 6,293,864 to Romero describe a gaming assembly to play an electronic variation of the game Baccarat, the gaming assembly including a computer processor assembly, a display assembly and at least one user actuatable selector assembly. The computer processor assembly is structured to generate a player's hand and a banker's hand in accordance with rules of Baccarat, one of those hands being designated the user's hand. Further, the computer processor assembly is structured to determine a winning hand in accordance with the rules of Baccarat, designating the user as a winner if the user's hand is also the winning hand. Additionally, the computer processor assembly is structured to monitor consecutive ones of the user's hands and to indicate a bonus payout to the user in the event that consecutive ones of the user's hands have a final number count equal to a natural nine.

The Romero patents describe the use of computers to determine at least bonus results and to display continuing progress of the game. The specification specifically states:

"Additionally, in yet another embodiment of the present invention, an automated gaming assembly is provided so as to make the game of Baccarat and preferably the above-recited variant, more accessible to the gaming public. To this end, the Baccarat gaming assembly may include a computer processor assembly, a display assembly, and user actuatable selector assembly. In particular, the display assembly allows the user to readily see the progress of the game in a manner simulating a conventional game, while the actuatable selector assembly allows the user to make any necessary decisions."

"Looking to the computer processor assembly, it is structured to generate a player's hand and a banker's hand in accordance with rules of Baccarat. Moreover, the computer processor assembly is also preferably structured to permit the user to elect whether their user hand is the player's hand or the banker's hand. As a result, the user may play hunches and the like to decide which hand to play. Once the hans [sic, hands] have been designated accordingly, the computer processor assembly is further structured to add cards to the player hand and the banker hand in accordance with the conventional rules of the card game Baccarat, ultimately identifying one of the hands as a winning hand. Naturally, if the winning hand is the user hand, the user is designated a winner and a corresponding payout is made. So as to further enhance the playing experience, however, the computer processor assembly is further preferably structured to keep track of consecutive ones of the user's hands, and to indicate a bonus payout to be paid to the user if a predetermined number count of nine occurs in at least two consecutive ones of the user's hands." Sensors are present above the table (not in a reading shoe) to determine the value of cards and hands. Column 8, lines 17-47 of U.S. Pat. No. 6,585,856.

"The camera assembly 32 and the display assembly 38 are electrically interconnected to one another as well as to an optical scanner 52 as schematically represented in FIG. 4. As set forth above, the optical scanner 52 is connected to both the camera assembly 32 and the display assembly 38 and is specifically structured and/or programmed, with the provision of a processor 54, to optically scan and/or electronically read the number count of at least one but preferably the total number count of the number of cards located in the card positioning section 26 of the specific player area 14 determined as being the banker. The electronic reading or optical scanning by the optical scanner 52 occurs by virtue of its connection to the one or more cameras of the cameras assembly 32 viewing the cards located at the card positioning section 26. Once the optical scanner 52 determines that the total number count of at least one or preferably two consecutive banker's hand is equal to a predetermined number count, the display portion 42 will begin to continuously register and display the number of consecutive hands. Once the consecutive number of hands is discontinued, the optical scanner will immediately determine such discontinuance, and the designated number 48 will revert back to zero or will go blank, as programmed, after indicating a plus payout is to be made." Column 10, line 66 through Column 11, line 21 of U.S. Pat. No. 6,585,856.

U.S. Pat. No. 4,667,959 to Pfeiffer et al. describes a card apparatus having a card hopper adapted to hold from one to at least 104 cards, a card carousel having slots for holding cards, an injector for sequentially loading cards from the hopper into the carousel, output ports, ejectors for delivering cards from the carousel to any one of the output ports, and a control board and sensors, all housed in a housing. The apparatus is also capable of communicating with selectors that are adjustable for making card selections. The injector has three rollers driven by a motor via a worm gear. A spring-loaded lever keeps cards in the hopper pressed against the first roller. The ejectors are pivotally mounted to the base of the housing beneath the carousel and comprise a roller driven by a motor via gears and a centripetal clutch. A control board keeps track of the identity of cards in each slot, card selections, and the carousel position. Cards may be ordinary playing cards or other cards with bar codes added for card identification by the apparatus.

U.S. Pat. No. 4,750,743 to Nicoletti describes the use of a mechanical card dispensing means to advance cards at least part way out of the shoe. The described invention is for a dispenser for playing cards comprising:

a shoe adapted to contain a plurality of stacked playing cards, the playing cards including a leading card and a trailing card; the shoe including a back wall, first and second side walls, a front wall, a base, and an inclined floor extending from the back wall to proximate the front wall and adapted to support the playing cards; the floor being inclined downwardly from the back wall to the front wall; the front wall having an opening and otherwise being adapted to conceal the leading card; and the front wall, side walls, base and floor enclosing a slot positioned adjacent the floor, the slot being sized to permit a playing card to pass through the slot;

card advancing means contacting the trailing card and adapted to urge the stacked cards down the inclined floor;

card dispensing means positioned proximate the front wall and adapted to dispense a single card at a time, the card dispensing means including leading card contact means adapted for rotation about an axis parallel to the leading card, whereby rotation of the leading card contact means displaces the leading card relative to the card stack and into a predetermined position extending out of the shoe from the slot; and an endless belt located in the opening in the front wall for rotating the leading card contact means, the endless belt having an exterior surface securely engaging the leading card contact means and being adapted to be displaced by an operator.

U.S. Pat. No. 5,681,039 to Miller describes a device for speeding the pace of a game of blackjack. The device is comprised of a housing having a top surface. A card reader for reading at least a portion of a playing card is located within the housing. An indicator cooperating with the card reader is provided to inform the dealer if his down card is of a desired value. There is also disclosed herein a method for increasing the speed of play in an organized game of Blackjack. This device is little more than a table-mounted "no peek" system enabling reading of single cards to determine if a blackjack occurs to a dealer during a game of Twenty-One. It indicates the presence of an ace or ten as the hole card in the dealers Blackjack hand.

U.S. Pat. No. 5,779,546 to Meissner describes a method and apparatus to enable a game to be played based upon a plurality of cards. An automated dealing shoe dispenses each of the cards and recognizes each of the cards as each of the cards is dispensed. Player stations are also included. Each player station enables a player to enter a bet, request that a card be dispensed or not dispensed, and to convert each bet into a win or a loss based upon the cards that are dispensed by the automated dealing shoe. This patent discloses card readers for the play of Blackjack. No mention is made of Baccarat or specifically how read data of card rank is used in determining Wins/Losses.

U.S. Pat. No. 5,989,122 to Roblejo relates to an apparatus for randomizing and verifying sets of playing cards. Also, the invention relates to a process of providing such an apparatus; feeding to the apparatus one or more cards, either after they have been played in a game or from an unrandomized or unverified set of cards; and manually retrieving a verified true set of cards from the apparatus. Also, the invention relates to a process of playing in a casino setting or simulated casino setting, a card game comprising providing such an apparatus, feeding unverified sets of playing cards to the apparatus, and recovering verified true sets of cards from the apparatus. The disclosure is directed toward a complete apparatus with stacking compartments that sorts and/or randomizes cards.

U.S. Pat. Nos. 5,605,334; 6,093,103 and 6,117,012 to McCrea, Jr., disclose apparatus for use in a security system for card games. There is some disclosure relevant to smart delivery elements in shuffling equipment. There is a description, for example, of a secure game table system for monitoring each hand in a progressive live card game, said progressive live card game having at least one deck, said at least one deck having a predetermined number of cards, said secure game table system having players at a plurality of player positions and a dealer at a dealer position, said secure game table system comprising:

a shoe for holding each card from said at least one deck before being dealt by said dealer in said hand, said shoe having a detector for reading at least the value and the suit of said each card, said detector issuing a signal corresponding at least to said value and suit for said each card, a game bet sensor located near each of said plurality of player positions for sensing the presence of a game bet, when the presence of said game bet is sensed, said game bet sensor issuing a signal corresponding to said presence, a progressive bet sensor located near each of said plurality of player positions for sensing the presence of a progressive bet, when said progressive bet is sensed, said progressive bet sensor issuing a signal corresponding to said presence, a card sensor located near each of said plurality of player positions and said dealer position, said card sensor issuing a signal when a card in said hand is received at said card sensor, a game control, said game control having a memory, said game control receptive of said game bet signals from said game bet sensor at each of said plurality of player positions for storing in memory which player positions have in place a game bet, said game control receptive of said value and suit signals from said detector in said shoe for storing in said memory at least the value and suit of each card dealt from said shoe in said hand, said game control receptive of said card received signals from said card sensor at each of said plurality of player positions and said dealer position for correlating in said memory each card dealt from said shoe in game sequence to each card received at a player position having a game bet sensed, said game control receptive of said progressive bet signals from said progressive bet sensor at each of said player positions for storing in said memory which player positions have in place a progressive bet.

The patents disclose the use of the read card values for purposes such as a card sensor located near each player position and the dealer position issues a signal for each card received. The game control receives these signals and correlates those player positions having placed a game and/or progressive bet with the received cards. The game control at each table has stored in memory the winning combinations necessary to win the progressive jackpots. Since the game control accurately stores the suit and value of each card received at a particular player position, the game control can automatically detect a winning progressive combination and issue an award signal for that player position.

U.S. Pat. No. 6,250,632 to Albrecht describes an apparatus and method for sorting cards into a predetermined sequence. One embodiment provides a deck holding area in which cards are held for presenting a card to a reading head for reading the characters on the face of the card. The apparatus also has a tray having a sequence of slots and a card moving mechanism for moving the presented card from the deck holding area into one of the slots. The tray is connected to a tray positioning mechanism for selectively positioning the tray to receive a card in one of the slots from the card moving mechanism. A controller is connected to the read head, the card moving mechanism, and the tray positioning mechanism. The controller controls the reading of each of the cards by the read head and identifies the value of each card read, and also controls the card moving mechanism to move each of the cards to a slot of the tray positioned by the tray positioning mechanism according to the predetermined sequence of values. The method for sorting includes the step of providing a tray having a sequence of slots, determining a predetermined sequence of values for the cards, and reading the face of a card to determine the value of the card. The method further includes moving the read card into one of the slots of the tray. The position of the slot into which the read card is moved corresponds to the position of the value in the predetermined sequence.

U.S. Pat. No. 6,267,248 to Johnson describes a collation and/or sorting apparatus for groups of articles, exemplified by a sorting and/or shuffling device for playing cards. The apparatus comprises a sensor (15) to identify articles for collation and/or sorting, feeding means to feed cards from a stack (11) past the sensor (15) to a delivery means (14) adapted to deliver cards individually to a preselected one of a storing means (24) in an indexable magazine (20). A microprocessor (16) coupled to the feed means (14), delivery means (18), sensor (15) and magazine (20) determines, according to a preprogrammed routine, whether cards identified by sensor (15) are collated in the magazine (20) as an ordered deck of cards or a randomly ordered or "shuffled" deck.

U.S. Pat. No. 6,403,908 to Stardust et al. describes an automated method and apparatus for sequencing and/or inspecting decks of playing cards. The method and apparatus utilizes pattern recognition technology or other image comparison technology to compare one or more images of a card with memory containing known good images of a complete deck of playing cards to identify each card as it passes through the apparatus. Once the card is identified, it is temporarily stored in a location corresponding to or identified according to its position in a properly sequenced deck of playing cards. Once a full set of cards has been stored, the cards are released in proper sequence to a completed deck hopper. The method and apparatus also includes an operator interface capable of displaying a magnified version of potential defects or problem areas contained on a card, which may then be viewed by the operator on a monitor or screen and either accepted or rejected via operator input. The present invention is also capable of providing an overall wear rating for each deck of playing cards.

The disclosure of this patent suggests identification of cards and storage of cards with the identity of the card recognized in a storage position. The cards are read and then stored in identified and recoverable positions.

U.S. Pat. No. 6,217,447 to Lofink et al. describes a method and system for generating displays related to the play of Baccarat. Cards dealt to each of the Banker's and Player's hands are identified by scanning and data signals are generated. The card identification data signals are processed to determine the outcome of the hand. Displays in various formats to be used by bettors are created from the processed identification signals including the cards of the hand played, historical records of outcomes and the like. The display can also show bettors expected outcomes and historical bests. Bettors can refer to the display in making betting decisions.

The cards are read between the shoe and the player positions outside of the shoe. "Disposed between the shoe 22 and areas 24, 26 is means for identifying the cards dealt to the Player and Banker hands. These means are embodied as any suitable card scanner 32. Scanner 32 optically scans each card 10 as it is dealt from the shoe 22 and swiped across the scanner 32, face down. When the cards 10 include [sic, include] a bar code (not shown) on their face that designates suit and denomination, the scanner 32 may be a laser scanner adapted to generate signals corresponding to the bar code. Preferably, to avoid the necessity of bar coding cards, the scanner 32 is of the type that optically scans the card face and generates data signals corresponding to the optical characteristics of the face of the card. As but an example, digital camera means can be used to generate data signals, broken in picture elements, i.e. pixels, the signal strength at the locations of the individual pixels collectively corresponding to the actual appearance of the face."

U.S. Pat. No. 5,669,816 to Garczynski et al. describes a "no peek" module for announcing when a Dealer has blackjack without exposing the face of the Dealer's down-card is disclosed. The module scans a character from the Dealer's face-down standard playing card, compares the result of the scan with a set of references, and identifies the down-card. The module also receives input from the Dealer as to the identity of the Dealer's up-card, and announces whether the Dealer has blackjack or the hand continues. The module is designed to be mounted to a blackjack table, such that the surface of the module on which the standard playing card rests while being scanned is in the plane of the surface of the blackjack table, allowing the Dealer to slide the down-card across the table and onto the scanner without lifting, and potentially exposing, the card's face. The module also removes the noise generated by a casino's heat, dust, cigarette and cigar ashes, and lint from the felt of the blackjack table, during the scanning process. The module further optimizes the scan of the character on the standard playing card by controlling the light intensity emitted by the components of the module used to illuminate the character.

U.S. Pat. No. 5,772,505 to Garczynski describes a dual card scanning module that announces when the symbols of a face-up standard playing card and a face-down standard playing card achieve a desired combination (a blackjack). The module has a scanner system that illuminates and scans at least a portion of a symbol of the face-up standard playing card and at least a portion of a symbol of the face-down standard playing card and stores the results thereof in a first and second array device, respectively. The module also has a guide to assist in receiving and positioning the cards such that the face-up standard playing card is above and aligned with the face-down standard playing card. When in this position, the symbol portions of the face-up and the face-down standard playing cards can be scanned by the array devices to generate respective scanning results. The module compares the scanning results with a memory storing a plurality of references representing respective symbols of the standard playing cards to determine if the cards have achieved the desired combination.

U.S. Pat. Nos. 6,582,301; 6,039,650; and 5,722,893 to Hill describes a shoe equipped with a card scanner that scans indicia on a playing card as the card moves along and out of a chute by manual direction by the dealer in the normal fashion. The scanner can be one of several different types of devices that will sense each card as it is moved downwardly and out of the shoe. A feed forward neural-network is trained, using error back-propagation to recognize all possible card suits and card values sensed by the scanner. Such a neural-network becomes a part of a scanning system that provides a proper reading of the cards to determine the progress of the play of the game including how the game might suffer if the game players are allowed to count cards using a card count system and perform other acts that would limit the profit margin of the casino. The shoe is also provided with additional devices that make it simple and easy to record data relevant to the play of the game. For instance, the shoe has means for accommodating a "customer-tracking-card" or preferred customer card that reads the personal information of a card holder from a magnetic strip on the card and this information travels with the preferred customer from game to game, throughout a casino, which the customer likes to play. An LCD display can also be part of the shoe and this display can be used to enter and retrieve vital player information as deemed necessary or desirable to the customer file opened when the magnetic strip reader reads the preferred customer card with the customer name and account number embedded within the card's magnetic strip. Scanned information is fed to a computer for extensive analysis.

U.S. Pat. No. 6,126,166 to Lorson et al. describes a system for monitoring play of a card game between a dealer and one or more players at a playing table, comprising: (a) a card-dispensing shoe comprising one or more active card-recognition sensors positioned to generate signals corresponding to transitions between substantially light background and dark pip areas as standard playing cards are dispensed from the card-dispensing shoe, without generating a bit-mapped image of each dispensed standard playing card; and (b) a signal processing subsystem. The subsystem may be adapted to: receive the transition signals generated by the active card-recognition sensors; determine, in real time and based on the transition signals, playing-card values for the dispensed standard playing cards; and determine, in real time, a current table statistical advantage/disadvantage relative to the players for playing cards remaining in the card-dispensing shoe. The system gathers information on the distribution of cards in the discard shoe from knowledge of the sequence of cards dealt during game play. When signaled, the system determines appropriate sequence, number, and positions of the pre-shuffle plug locations of the cards in the discard shoe. The system transmits the pre-shuffle card plug information to an output device driver assembly that actuates the desired output devices. In one implementation, the system output devices are light-emitting diodes, but any number of electric, acoustic, or mechanical devices could be utilized. The dealer plugs the card segments as directed by the system output devices and signals completion by operating the control switch discussed above. The process is repeated until the card segments are properly positioned and then the system transmits an output signal to direct the dealer to shuffle the cards. This pre-shuffle mixing technique significantly reduces the post-shuffle statistical deck variations and improves current pre-shuffle mixing practices that are performed arbitrarily by the dealer and do not ensure adequate and consistent distribution of the card values following the shuffle. During play, the system monitors the cards received by the dealer and actuates an output device any time the dealer's first two cards consist of an ace and any ten-valued card. When the first card received by the dealer is an ace, the passive table-mounted sensor delays actuation of the output device until all players have had the opportunity to place an optional blackjack game wager commonly referred to as insurance.

U.S. Pat. No. 5,941,769 to Order describes a device for professional use in table games of chance with playing cards and gaming chips (jettons), in particular, the game of "Black Jack." An automatically working apparatus is provided that will register and evaluate all phases of the run of the game automatically. This is achieved by a card shoe with an integrated device for recognition of the value of the drawn cards (3') (optical recognition device and mirroring into a CCD-image converter); photodiodes (52) arranged under the table cloth (51) in order to register separately the casino light passing through each area (53,54) for placing the gaming chips (41) and areas (55,56) for placing the playing cards (3) in dependence of the arrangement or movement of the jettons and playing cards on the mentioned areas; a device for automatic recognition of each bet (scanner to register the color of the jettons, or an RFID-system comprising an S/R station and jettons with integrated transponder); an EDP program created in accordance with the gaming rules to evaluate and store all data transmitted from the functional devices to the computer; and a monitor to display the run of the game and players' wins.

U.S. Pat. No. 6,299,536 to Hill (assigned to Smart Shoes, Inc.) describes an optical scanner coupled to a CPU that reads the value of each card dealt to each player's hand(s) and the dealer's hand as each card is dealt to a specific hand, seat or position and converts the game card value of each card dealt from the shoe to the players and the dealer of the game to a card count system value for one or more card count systems programmed into the evaluation software. The CPU records each player's decision(s) to hit a hand, and the dealer's decision to hit or take another card when required by the rules of the game, as the hit card is removed from the shoe. The dealer uses one or more of the keyboards and LCD displays carried by the shoe to record each player's decisions(s) to Insure, Surrender, Stand, Double Down, or Split a hand. When the dealer has an Ace or a Ten as an up-card, he/she may use one or more of the keyboards to prompt the computer system's software, since the dealer's second card, or hole-card, which is dealt face down, has been scanned and the game card value thereof has been imported into the computer system's software, to instantly inform the dealer, by means of one or more of the shoe's LCDs, if his/her game cards, or hand total, constitutes a two-card "21" or "Blackjack. " The accuracy of the data input to the evaluation software program by this means cannot be duplicated using any type of prior art or VCR recording of a twenty-one game previously played and recorded, or currently in progress.

U.S. Pat. No. 6,460,848 to Soltys et al. (assigned to Mind-Play LLC) describes a system that automatically monitors playing and wagering of a game, including the gaming habits of players and the performance of employees. A card deck reader automatically reads a symbol from each card in a deck of cards before a first one of the cards is removed. The symbol identifies a respective rank and suit of the card. A chip tray reader automatically images the contents of a chip tray to periodically determine the number and value of chips in the chip tray, and to compare the change in contents of the chip tray to the outcome of game play for verifying that the proper amounts have been paid out and collected. A table monitor automatically images the activity occurring at a gaming table. Periodic comparison of the images identify wagering, as well as the appearance, removal and position of cards and other game objects on the gaming table. A drop box automatically verifies an amount and authenticity of a deposit and reconciles the deposit with a change in the contents of the chip tray. The drop box employs a variety of lighting and resolutions to image selected portions of the deposited item. The system detects prohibited playing and wagering patterns, and determines the win/loss percentage of the players and the dealer, as well as a number of other statistically relevant measures. The measurements provide automated security and real-time accounting. The measurements also provide a basis for automatically allocating complimentary player benefits. There are numerous other MindPlay LLC patents, including at this time, U.S. Pat. Nos. 6,712,696; 6,688,979; 6,685,568; 6,663,490; 6,652,379; 6,638,161; 6,595,857; 6,579,181; 6,579,180; 6,533,662; 6,533,276; 6,530,837; 6,530,836; 6,527,271; 6,520,857; 6,517,436; and 6,517,435.

WO 00/51076 and U.S. Pat. No. 6,629,894 to Purton (assigned to Dolphin Advanced Technologies Pty. Ltd.) disclose a card inspection device that includes a first loading area adapted to receive one or more decks of playing cards. A drive roller is located adjacent the loading area and positioned to impinge on a card if a card were present in the loading area. The loading area has an exit through which cards are urged, one at a time, by a feed roller. A transport path extends from the loading area exit to a card accumulation area. The transport path is further defined by two pairs of transport rollers, one roller of each pair above the transport path and one roller of each pair below the transport path. A camera is located between the two pairs of transport rollers, and a processor governs the operation of a digital camera and the rollers. A printer produces a record of the device's operation based on an output of the processor, and a portion of the transport path is illuminated by one or more blue LEDs.

Each of the references identified in the Background of the Art and the remainder of the specification, including the Cross-Reference to Related Applications is incorporated herein by reference in its entirety as part of the enabling disclosure for such elements as apparatus, methods, hardware and software. It would be desirable to provide a system comprising software and hardware that could monitor the game of Baccarat.

SUMMARY OF THE INVENTION

A playing card delivery shoe is designed for use in the play of the casino table card game of Baccarat. From the delivery shoe, cards may be dealt. One embodiment of such a shoe may comprise a) an area for receiving a first set of playing cards useful in the play of the casino table card game of Baccarat; b) first card mover that moves playing cards from the first set to a playing card staging area wherein at least one playing card is staged in an order by which playing cards are removed from the first set of and moved to the playing card staging area; c) second playing card mover that moves playing cards from the playing card staging area to a delivery area wherein playing cards removed from the staging area to the delivery shoe are moved in the same order by which playing cards were removed from the first set of playing cards and moved to the playing card staging area; and d) at least one playing card reading sensor that reads at least one playing card value of each playing card separately after each playing card has been removed from the area for receiving the first set of playing cards and before removal from the playing card delivery area. There is a communication link between the playing card reading sensors and a processor, which processor analyzes the data according to rules of play of the game of Baccarat and determines results of play for a round of play of Baccarat based upon the data.

DETAILED DESCRIPTION OF THE INVENTION

Figure 1:
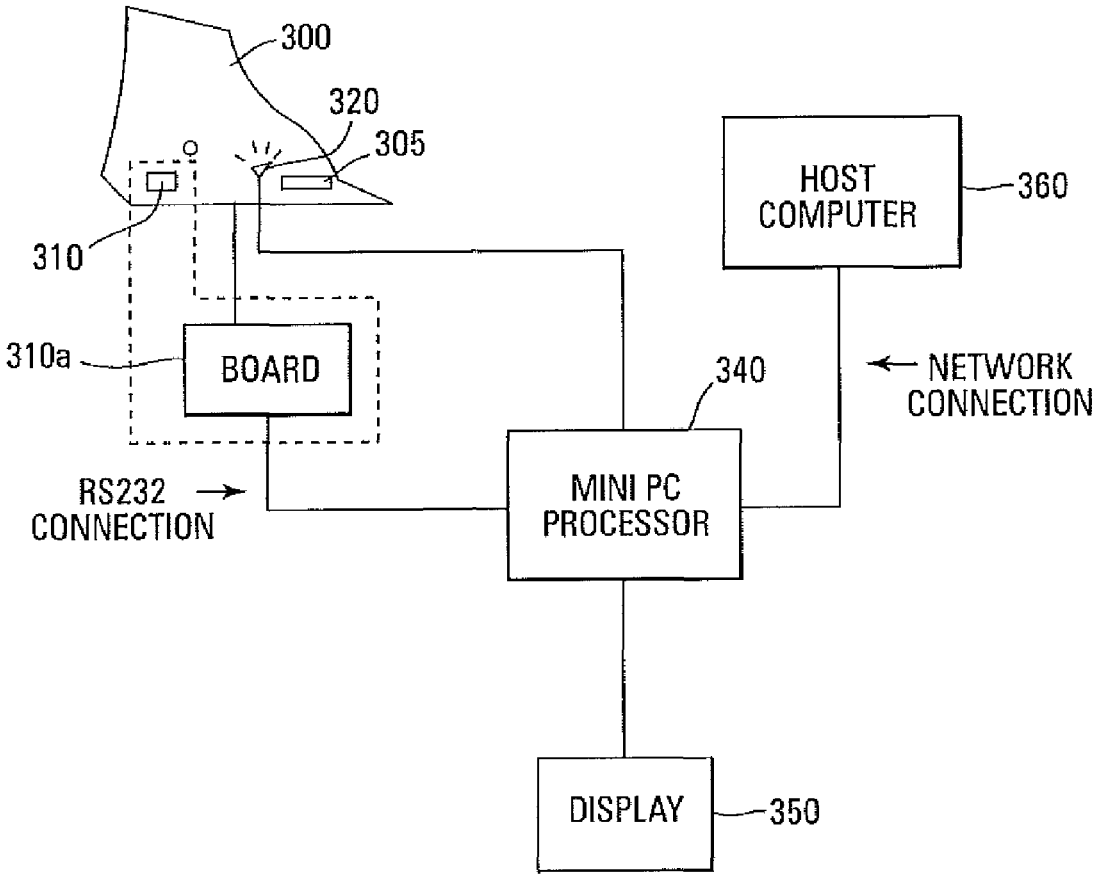
FIG. 1 is a schematic view of an exemplary Baccarat control system of the present invention.

Baccarat is one of the many live table games played in casinos or gaming establishments. Baccarat uses a standard deck of 52 playing cards and is usually dealt from a shoe having multiple decks that have been shuffled together prior to the beginning of play.

The object of the game of Baccarat is for the bettor to successfully wager on whether the surrogate Banker hand or the surrogate Player hand is going to win, e.g., have a hand count, modulo ten, closest to the target count of nine. The bettor receives even money for his wager if he selects the winning hand and loses his wager if he selects the losing hand. Because of the rules of play of Baccarat and, more particularly, the pre-established draw rules, the Banker hand has a slightly higher chance of winning than does the Player's hand. Therefore, if the bettor wagers on the Banker hand and the Banker hand wins, the bettor must pay to the gaming establishment a commission (typically, 5%) of the amount the bettor wins. No commission is paid if the bettor successfully wagers on the Player hand. The bettor can also wager on the occurrence of a tie and is paid 8:1 on the bet for a tie hand.

As used in this specification, the term "Conventional Manner of Play of Baccarat" is as follows:

A multiple number of decks of standard playing cards, 52 in number, are used; typically eight decks are shuffled together and placed in a shoe from which the cards are dealt during the play of the game.

Each bettor makes a wager on whether the Bank's hand or the Player's hand will win or tie. After all wagers are made, cards are dealt from the shoe to the Bank position and from the shoe to the Player position on the table layout. Each hand has two cards The cards are turned face up and the values of the Bank hand and the Player hand are determined, modulo ten (meaning, the ten column in the total sum is ignored).

Aces count one; Kings, Queens, Jacks and Tens count zero and the other cards count their respective face value. The suits (Spades, Hearts, Diamonds and Clubs) have no meaning in Baccarat.

The highest hand value in Baccarat is nine. All hand values range from a low of zero to a high of nine. If when the cards are added together, the total of the hand exceeds nine, then the hand value is determined modulo ten. For example, a seven and a eight total fifteen, but the hand value is five. An Ace and a nine total ten, but the hand value is zero.

A two-card total of eight or nine is called a "natural"; a two-card total of zero is called a "baccarat." As will be explained below, in certain situations in the play of the game, a third card will be dealt. The value of this third card is added to the total of the first two cards and a new hand value is established. Again, if the new hand total exceeds nine, the hand value is determined by subtracting ten from the total of the hand.

Prior to the deal, each bettor can make one of three wagers: 1) that the Bank hand will win; 2) that the Player hand will win; or 3) that the Bank hand and the Player hand will tie. Wagering locations are provided on the Baccarat table layout. Whichever of the Bank hand or the Player hand is closest to a total of nine is the winner.

All winning Bank hand wagers are paid off at odds of one-to-one and the house charges a five percent (5%) commission on the amount won by the bettor. For example, if a bettor wagers $100 on the Bank hand and the Bank hand wins, the bettor wins $100 and is charged a $5 commission on the amount that the bettor won. The bettor is not charged any commission on the amount of his wager.

All winning Player hand wagers are paid off at odds of one-to-one and the bettor is not charged any commission on the amount of his winnings or his wager because the house Banker hand, by virtue of the third card draw rules, has a statistical advantage over the Player hand. Winning wagers on the Tie hand bet are paid off at odds of nine-to-one or eight-to-one (depending on the gaming establishment) and the bettor is not charged any commission on the amount of his winnings or his wager since there is already a statistical advantage in favor of the house on tie wagers. If a Tie hand occurs, all wagers on the Bank hand and all wagers on the Player hand are "pushes" and the amount wagered is returned to the bettor.

Depending on the point total of the Player's hand and the Banker's hand, one more card may be dealt to the Player's hand, the Banker's hand or both. The rules for determining whether a third card is dealt are fixed rules; there is no discretion for either the Player's hand or the Banker's hand on whether a third card is dealt.

If either the Player hand or the Banker hand has a point total of eight or nine on the first two cards, no third card is dealt to either hand and the hand with the highest point total is the winner (or the hand is a Tie, as the case may be). If neither the Player hand nor the Banker hand has a point total of eight or nine, then there is a possibility of a third card draw.

The third card draw rules are as follows:

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Bank hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

| Banker hand two card point total | Banker hand DRAWS when the Player's hand third card is: | Banker hand STANDS when the Player's hand third card is: |
|---|---|---|
| 0, 1 or 2 | | Banker always draws |
| 3 | 0, 1, 2, 3, 4, 5, 6, 7 or 9 | 8 |
| 4 | 2, 3, 4, 5, 6, or 7 | 0, 1, 8 or 9 |
| 5 | 4, 5, 6 or 7 | 0, 1, 2, 3, 8 or 9 |
| 6 | 6 or 7 | 0, 1, 2, 3, 4, 5, 8 or 9 |
| 7 | | Banker always stands |

The draw rules for conventional Baccarat are summarized below.

| BACCARAT RULES (Note: 10s the same as 0) | |
|---|---|
| PLAYER HAVING TWO-CARD TOTAL OF: | |
| 1-2-3-4-5-10 | DRAWS A CARD |
| 6-7 | STANDS |
| 8-9 | TURNS CARDS OVER |

| HAVING TWO-CARD TOTAL OF | BANKER DOES NOT DRAW WHEN PLAYER'S THIRD CARD DRAW IS: | DRAW WHEN PLAYER'S THIRD CARD DRAW IS: |
|---|---|---|
| 0, 1, 2 | ALWAYS DRAWS | |
| 3 | 1-2-3-4-5-6-7-9-10, none | 8 |
| 4 | 2-3-4-5-6-7-none | 1-8-9-10 |
| 5 | 4-5-6-7, none | 1-2-3-8-9-10 |
| 6 | 6-7 | 1-2-3-4-5-8-9-10, none |
| 7 | | STANDS |
| 8-9 | | TURNS CARDS OVER |

At the end of each hand, winning wagers are paid and losing wagers are collected by the house. Any commission due to the house is marked in commission boxes in the center of the table. Gaming chips are used to represent the amount of money owed by each bettor to the house for the commissions. In order not to slow down the game, the commission is not actually collected from each bettor until the end of the round determined by all of the cards in the shoe being dealt down to the plastic cut card, usually approximately eighty hands.

Among the features that describe some fundamental apparatus that may be included within systems of the present invention, specifically for enabling Baccarat functionality, the rules of the game described in greater detail above may be at least the following elements:

1) A distinct dealer shoe that has no shuffling capability.
2) Pre-shuffled cards are inserted into the shoe for dealing.
3) The shoe mechanically feeds the cards to the dealer accessible opening.
4) An intermediate number of cards are positioned between the input area and the removal area to increase the overall speed of card feed with reading to the dealer.
5) Sensors indicate when the dealer accessible area is empty and cards are fed from the buffer zone and read, one at a time.
6) The separate reading shoe is provided as present reading systems are too large to easily fit into existing shuffler structures.

One set of individual and/or collective primary purposes of the Baccarat content of the dealing shoe is to enable:

1) The shoe to read the cards, either as being dealt (as they leave the shoe) and/or as they are fed into the dealing chamber of the shoe.
2) Based on fixed rules of Baccarat, which are simple and readily treated by algorithms and mathematic formulae, Wins/Losses on each round of play can be determined.
3) The information (rank) relating to the cards read by the Baccarat dealing shoe are provided to a processor and the value of each hand is determined.
4) The Win/Loss information can be used to display the winning results on a display device and to determine Wins/Losses.
5) The data from the Baccarat dealing shoe is transferred and processed in real time.

The present invention is a system for monitoring the game of Baccarat. One example of the system is shown in FIG. 1 and includes a card dealing shoe 300 with a processing board 310. The board 310 is either located within the card dealing shoe 300 or external to the shoe 310*a*. The processing board 310 communicates with an external mini-PC 340 via a standard serial port such as an RS 232 serial port. The processing board 310 controls all aspects of the operation of the dealing shoe 300. Examples of functions controlled by the board 310 are dispensing cards, moving cards along a transport path by controlling motors and/or card feed rollers, moving cards from a card infeed into the transport path, and receiving signals from an external source such as a table game control system to control operation of the device. The shoe 300 in one example of the invention has a digital display 305. The digital display 305 is capable of displaying information about the rank and/or suit of cards dealt, rounds dealt, cards remaining in the shoe 300, cumulative number of cards dealt, hand composition, the player hit card, player hit rules, dealer hit rules, card jams, card movement, presence of the cut card, an indication to deal a hit card, the card count of the player and/or banker hands and any other information collected by the processing board 310 and/or the mini-PC (or mini-processor) 340. In one form of the invention, only information processed by board 310 is shown on the display 305. In another example of the invention, the display 305 includes information from the mini-PC 340 as well as the board 310.

Initially, pre-shuffled cards are loaded into the shoe 300. Cards are scanned with a scanning device 320 such as a digital camera. The digital output is fed directly to an external mini-computer 340 so that the rank information read from the cards can be extracted and used to determine the composition of the player and banker hands. In one example of the invention, the camera is connected to the mini computer via a FIREWIRE® (IEEE1394). In other examples of the invention, the board 310 processes the signal from the scanning device 320.

In one example of the invention, the mini-computer 340 date stamps the digital information and passes the information in real-time to a host computer 360, where the information can be further analyzed and stored. Residing in the memory of the mini-computer 340 is a program that processes the digital signal from the scanning device 320 and converts the signal to a representation of rank, suit and/or rank and suit. Since the suit of each card is irrelevant to the play of Baccarat, preferably the software extracts only rank information. One example of suitable software used to extract the rank (and/or suit) information is a type of machine vision API called eVision from Euresys Inc., Itasca, Ill.

The mini-PC 340 is also programmed with the rules of Baccarat. A display 350 can be provided for displaying information relating to the rank of the cards and other information that relates to game rules. For example, the player hand must always take a hit card when the point count of the two-card hand is a five or below. After the mini-PC 340 processed the player hand and calculated the point count, it could also display an instruction for the dealer to deal a hit card. After the player hit card was scanned, the display 350 could display this card along with the appropriate instruction for whether or not to deal a hit card to the banker hand. The display could also identify and display the winning hand. Any information displayed on the shoe display 305 can be displayed on the external display device 350. Most information displayed on the display device 350 can also be displayed on the shoe display 305, with the exception of some high resolution graphics or a display that produces a large amount of information.

Although the mini-PC 340 is programmed to determine game outcomes and otherwise provide the dealer with the necessary information to correctly administer the game, the system may also optionally be capable of sending time and/or date-stamped data to a host computer 360 for storage and/or later analysis. Examples of data that can be transferred to a host computer 360 includes player hand count, dealer hand count, value of the hit cards dealt and game outcomes. If the gaming table includes a player identification/tracking system, this information can also be time/date stamped, uploaded and associated with the game information in order for the host computer 360 to analyze playing habits of individual players, such as an amount of time spent on the table, for example. The system could also be used in connection with wagering monitoring devices in order to obtain betting habits of players. The method of data transfer can be via a standard network connection such as TCP/IP networking. Other networking methods such as internet, Ethernet or wireless networking can also be used. The information transferred to a host computer 360 may be encrypted and/or time delayed in order to secure the content of the transmission.

One exemplary dealing shoe implemented specifically for use in the play of Baccarat provides additional functions without greatly increasing the space on the casino table top used by the dealing shoe. The shoe provides cards securely to a delivery area and reads each card before it is actually positioned in the card delivery area. The card reading information is either stored in the mini-PC 340 or transferred to a central computer 360 for storage and/or evaluation. The cards are mechanically transferred from a point of entry into the dealing shoe to the card delivery area, with a buffer area in the path where at least some cards are actually held for a period of time. The cards are preferably read before they are delivered into the card delivery area. In one example of the dealing shoe 300, only one card is held in the card delivery area at a time.

Figure 2:
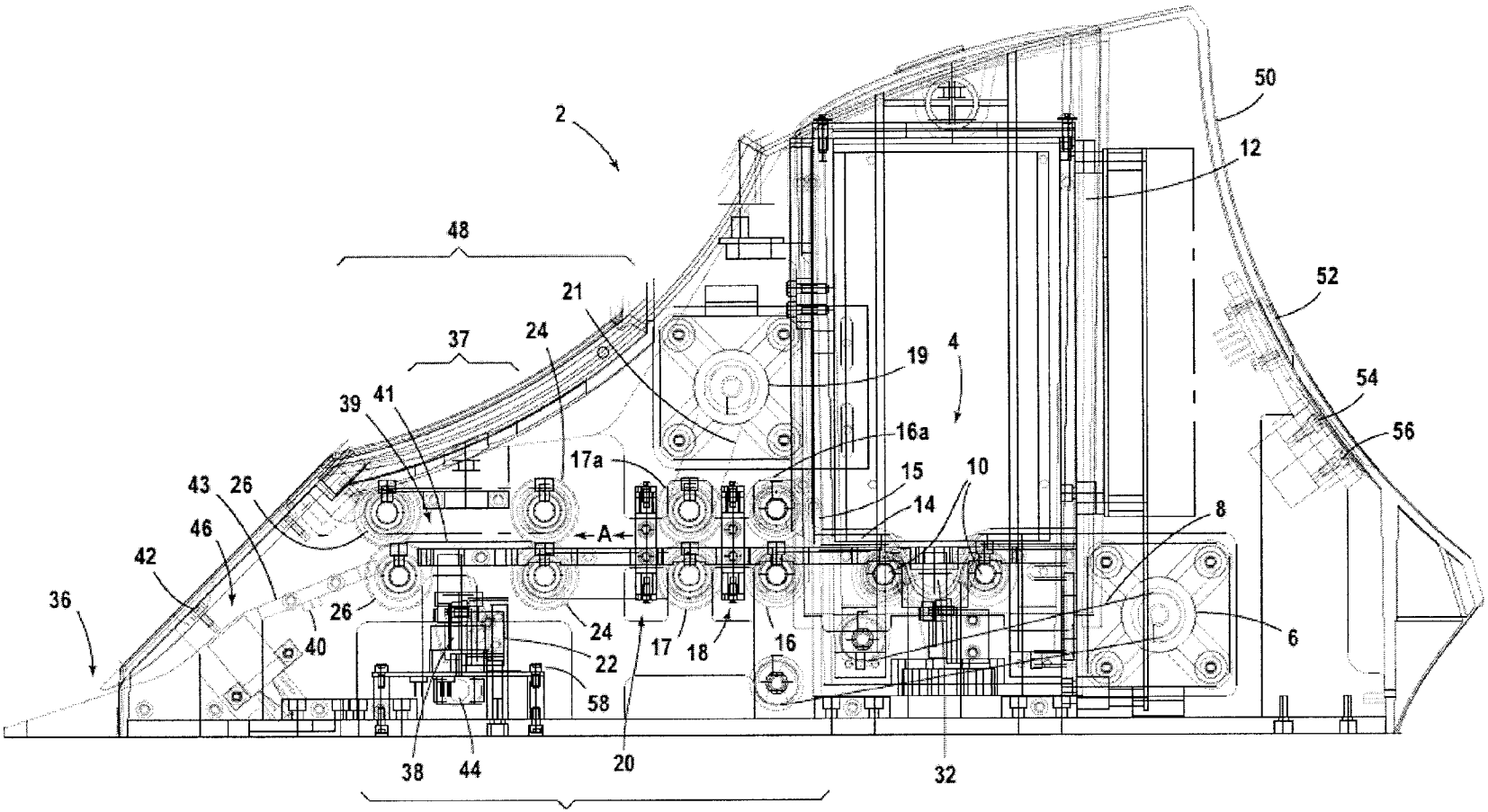
FIG. 2 shows a cutaway view of a side of a dealing shoe used to practice an example of the invention.

Reference to the remaining figures will help in an appreciation of the nature and structure of one embodiment of the card delivery shoe 300 of the invention that is within the generic practice of the claims and enables practice of the claims in this application. FIG. 2 shows an exemplary card delivery shoe 2. The card delivery shoe 2 has a card infeed or card input area 4 that is between a belt driving motor 6 and the rear panel 12 of the card delivery shoe 2. The belt driving motor 6 drives a belt 8 that engages pick off rollers 10. These pick off rollers 10 pick off and move individual cards from within the card infeed area 4. A belt driving motor 6 is shown, but other motor types such as gear drives, axel drives, magnetic drives and the like may be alternatively used. The pick off rollers 10 drive individual playing cards (not shown) into gap 14 having a deflector plate 15 to direct cards individually through the gap 14 to engage brake rollers 16. The brake rollers 16 control the movement of individual cards past the rear panel 12 and into the card staging area 34. The brake rollers 16 are capable of becoming free-turning rollers during a card jam recovery process so that little or no tension is placed on a card as it is being moved by the system or manually to free a jam. A simple gear release or clutch release can effect this function. Speed up rollers 17 apply tension to a card to move it more deeply into the card staging area 34. The speed up rollers can and may turn faster than the brake rollers 16, and the speed up rollers 17 may be driven by a separate motor 19 and belt drive 21. A card path and direction of movement A is shown through the card storage area 34. As individual cards are passed along the card path A through the card storage area 34, there are card presence sensors 18, 20, and 22 located at various intervals and positions to detect the presence of cards to assure passage of cards and/or to detect stalled or jammed cards. The path A through the card storage area 34 is in part defined by speed up rollers 17 or rear guide rollers 24 and forward guide rollers 26, which follow the brake rollers 16 and the speed up rollers 17. One form of a buffer area 48 is established by the storing of cards along card path A. As cards are withdrawn from the delivery end 36 of the delivery shoe 2, additional cards are fed from the buffer area 48 into the card feed chute 46 into the delivery end 36.

It is always possible for cards to jam, misalign or stick during internal movement of cards through the dealing shoe. There are a number of mechanisms that can be used to effect jam recovery. The jam recovery may be based upon an identified (sensed) position of jam, a sensed change in angular rotation of a shaft supporting card moving rollers, changes in timing of sensed cards or may be an automated sequence of events. Where a card jam recovery is specifically identified by the sensed position of a jammed card in the device (and even the number of cards jammed may be estimated by the dimensions of the sensed image), a jam recovery procedure may be initiated at that specific location. A specific location in FIG. 1 within the dealing shoe (e.g., between and inclusive of rollers 16 and 17) will be discussed from an exemplary perspective, but the discussion relates to all other positions within the device.

If a card is sensed (e.g., by sensors 18 and/or 20) as jammed between rollers 16 and 17 (e.g., a jam occurs when cards will not move out of the position between the rollers and cards refuse to be fed into that area), one of a various number of procedures may be initiated to recover or remove the jam. Among the various procedures that are discussed by way of non-limiting examples, include at least the following: The rear-most set of rollers (16 and 16*a*) may reverse direction (e.g., 16 begins to turn clockwise and 16*a* begins to turn counterclockwise) to remove the jammed card from between the rollers (16 and 16*a*) and have the card extend backwards into the space 14, without attempting to reinsert a card into the stacking area 4. The reversed rotation may be limited to assure that the card remains in contact with the rollers 16 and 16*a*, so that the card can be moved back into progression through the dealing shoe. An optional part of this reversal can include allowing rollers 17 and 17*a* to become free-rolling to release contact and tension on the card during the reversal. The reversed rotation may be smoothly run or episodic, attempting to jerk a jammed card from its jam position. If that procedure does not work or as an alternative procedure, both sets of rollers 16 and 17 may reverse at the same time or in either sequence (e.g., 16 first or 17 first) to attempt to free the jam of a card. When one set of rollers only is turning, it is likely to be desirable to have the other set of rollers in the area of the jam to become free-rolling. It is also possible to have the rollers automatically spaced further apart (e.g., by separating roller pairs to increase the gap in the potential nip between rollers) to relieve tension on a card and to facilitate its recovery from a jam. The adjacent pairs of rollers (e.g., 16, 16*a* and 17, 17*a*) can act in coordination, in sequence, in tandem, in order, independently or in any predefined manner. For example, referring to the roller sets as 16 and 17, the recovery process may have the rollers act as a) (16-17) at the same time in the same direction), b) (16-17) at the same time in the opposite directions to assist in straightening out cards, c) (16 then 17) to have the rollers work sequentially, d) (17 then 16) to have the rollers work in a different sequence, e) 16 only for an extended time, and then 17 operating alone or together with 16, f) 17 only for an extended time or extended number of individual attempts and then 16 for a prescribed time, etc. As noted earlier, a non-active roller (one that is not attempting to drive or align cards) may become free-rolling during operation of another roller.

These various programs may be performed at a single jam location in series or only a single program for jam recovery may be effected. In addition, as the card may have been read at the point of the jam or before the jam, the rank and value of the card jammed may be identified and this can be displayed on the display panel on the dealing shoe, on the central computer or on a shuffler connected to the dealing shoe, and the dealer or pit boss may examine that specific card to make certain that no markings or damage has occurred on that card which could either cause further problems with the dealing shoe or shuffler or could enable the card to be identified when it is in the dealing position in the shoe at a later time. The pit crew can then correct any problem by replacement of that specific card, which would minimize down time at the card table. Also, if a jam cannot be recovered, the delivery shoe would indicate a jam recovery failure (e.g., by a special light or alphanumeric display) and the pit crew would open the device and remove the jam manually.

Individual playing cards (not shown) may be read at one or more various locations within the card delivery shoe 2. The ability to provide multiple read locations assures performance of the shoe, while other card delivery trays with read capability usually had a single reading position at the point where and when cards were removed from the shoe for delivery to players. For example, in the construction shown in FIG. 2, the card presence sensors 18, 20 and 22 may also have card reading capabilities, and other card reading sensors may be present as elements 32, 40 and 42. Element 38 may be optionally present as another sensing element or a card value (and possibly suit) reading element without the presence of sensor 22 or in combination with sensor 22. When the sensor 38 functions as a card reading element, it should read the cards as they are positioned into the card pre-delivery area or card buffer area 37, rather than as the cards are removed from the card delivery end 36. Information may be read by the card reading sensor 38, by either continuous reading of all image data in the card pre-delivery area or by triggered on-off imaging of data in a specific region of cards 39 as a card 41 is within the pre-delivery area 37. For example, card presence sensor 22 may activate sensor 38. This sensor is preferably a camera, such as a digital camera. A light source (not shown) may be provided to enhance the signal to the sensor 38 or, a digital camera may include the light source. That specific region of cards is preferably a corner of the card 41 wherein complete value information (and possibly suit information) is readable on the card, such as a corner with value and suit ranging symbols on the card. That region could also be the entire face of the card, or at least ½ of the card (lengthwise divided). By increasing the area of the region read, more processing and memory is required, but accuracy is also increased. Accuracy could also be increased by reading the upper right-hand corner of the card and lower left-hand corner, since both of those locations contain the rank and suit of the card. By reading two locations on the card, defects or dirt on the card can be circumvented. By using on-off or single-shot imaging of each card 41, the data flow from the sensor/card reading element 38 is minimized and the need for larger memory and data transmission capability is reduced in the system. Information may be transferred from the card reading elements (e.g., 32) from a communication port or wire 44 shown for sensor/reading element 32. Cards may be buffered or staged at various points within the dealing shoe 2, such as where restrained by rollers 26, so that cards partially extend toward the chute 46 past the rollers 28 on plate 43, or staged between rollers 24 and 26, between rollers 17 and 24, between rollers 16 and 17 and the like. Cards may partially overlap in buffering as long as two or more cards are not present between a single set of nip rollers (e.g., 26 and 27) where nip forces may drive both cards forward at the same time.

Other variations are available and within the skill of the artisan. For example, rear panel 12 may have a display panel thereon for displaying information or data, particularly to the dealer (which information would be shielded from players as the rear panel 12 would primarily face the dealer and be shielded from players' view. A more ergonomic and aesthetic rear surface 50 is shown having a display 52 that is capable of providing alphanumeric (letters and numbers) or analog or digital images of shapes and figures in black-and-white or color. For example, the display may give messages as to the state of the shoe, time to number of cards dealt, the number of deals left before a cut card or virtual cut card is reached (e.g., the dealing shoe identifies that two decks are present, makes a virtual cut at 60 cards, and based on data input of the number of players at the table, identifies when the next deal will be the last deal with the cards in the shoe), identify any problems with the shoe (e.g., low power, card jam, where a card is jammed, misalignment of cards by rollers, and failed element such as a sensor), player hands, card rank/suit dispensed, and the like. Also on the rear surface 50 are two lights 54 and 56, which are used to show that the shoe is ready for dealing (e.g., 54 is a green light) or that there is a problem with the dealing capability of the shoe (e.g., 56 is a red light). The memory board 58 for the card reading sensor 38 is shown with its information outlet 44 shown. In the alternative, board 310 or the mini PC 340 memory (both shown in FIG. 1) can be used as the memory board for sensor 38.

There are significant technical and ergonomic advantages to the present structure. By having the card infeed area 4 provide the cards in at least a relatively vertical stack (e.g., with less than a 60° slope of the edges of the cards away from horizontal), length of the delivery shoe 2 is reduced to enable the motor driven delivery and reading capability of the shoe in a moderate space. No other card delivery shoes are known to combine vertical card infeed, horizontal (or approximately horizontal ±40° slope or ±30° slope away from horizontal) card movement from the infeed area to the delivery area, with mechanized delivery between infeed and delivery. The motor drive feed from the vertical infeed also reduces the need for dealers to have to jiggle the card tray to keep cards from jamming, slipping to undesirable angles on the chutes, and otherwise having to manually adjust the infeed cards, which can lead to card spillage or exposure as well as delaying the game.

Figure 3:
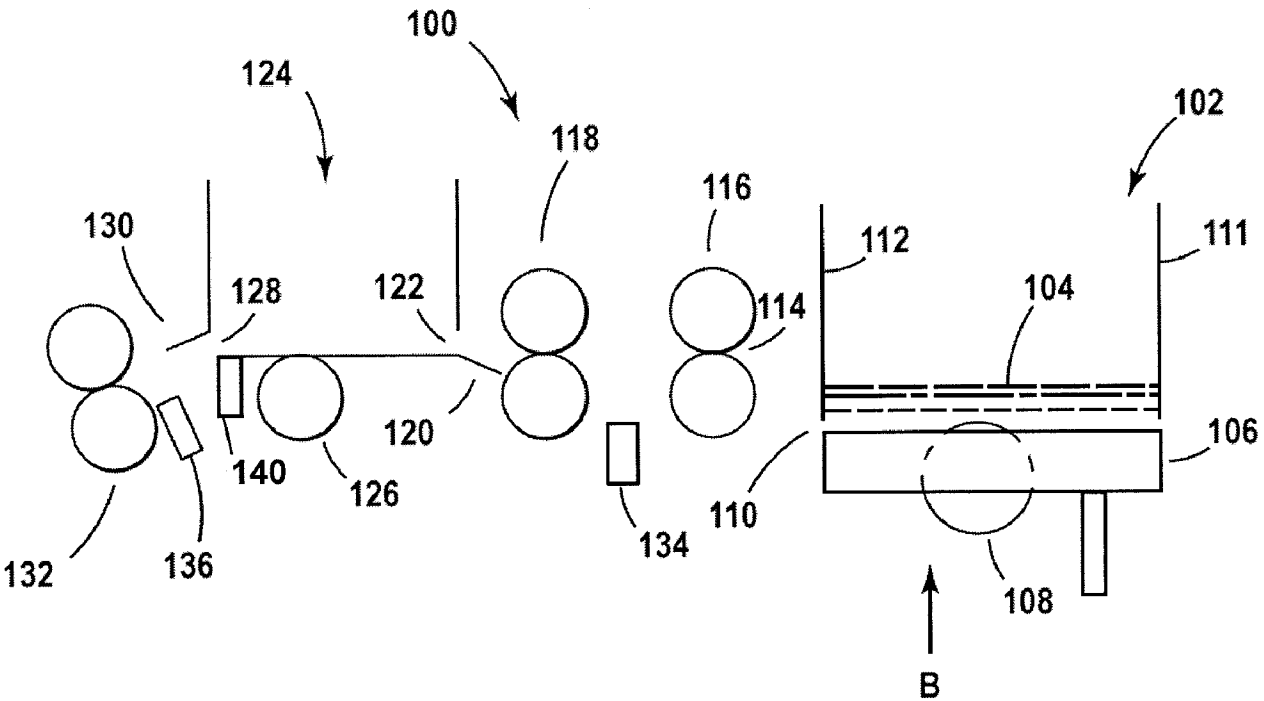
FIG. 3 shows a schematic cross-sectional view of a dealing shoe with a card reading and buffer area.

FIG. 3 shows an alternative embodiment for internal card buffering and card moving elements of the card delivery tray 100. A card infeed area 102 is provided for cards 104 that sit between walls 111 and 112 on elevator or stationary plate 106 that moves vertically along path B. A pick-off roller 108 drives cards one at a time from the bottom of the stack of cards 104 through opening 110 that is spaced to allow only one card at a time to pass through the opening 110. The individual cards are fed into the nip area 114 of the first set of speed control or guide rollers 116 and then into the second set of speed control or guide rollers 118. The cards (one at a time) passing through rollers 118 are shown to deflect against plate 120 so that cards flare up as they pass into opening 122 and will overlay any cards (not shown) in card buffer area 124. A second pick-off roller 126 is shown within the buffer area 124 to drive cards one at a time through opening 128. The individual cards are again deflected by a plate 130 to pass into guide rollers 132 that propels the cards into the delivery area (not shown) similar to the delivery area 36 in FIG. 2. Card reading elements may be positioned at any convenient point within the card delivery element 100 shown in FIG. 3, with card reading elements 134, 136 and 140 shown at exemplary convenient locations.

Figure 4:
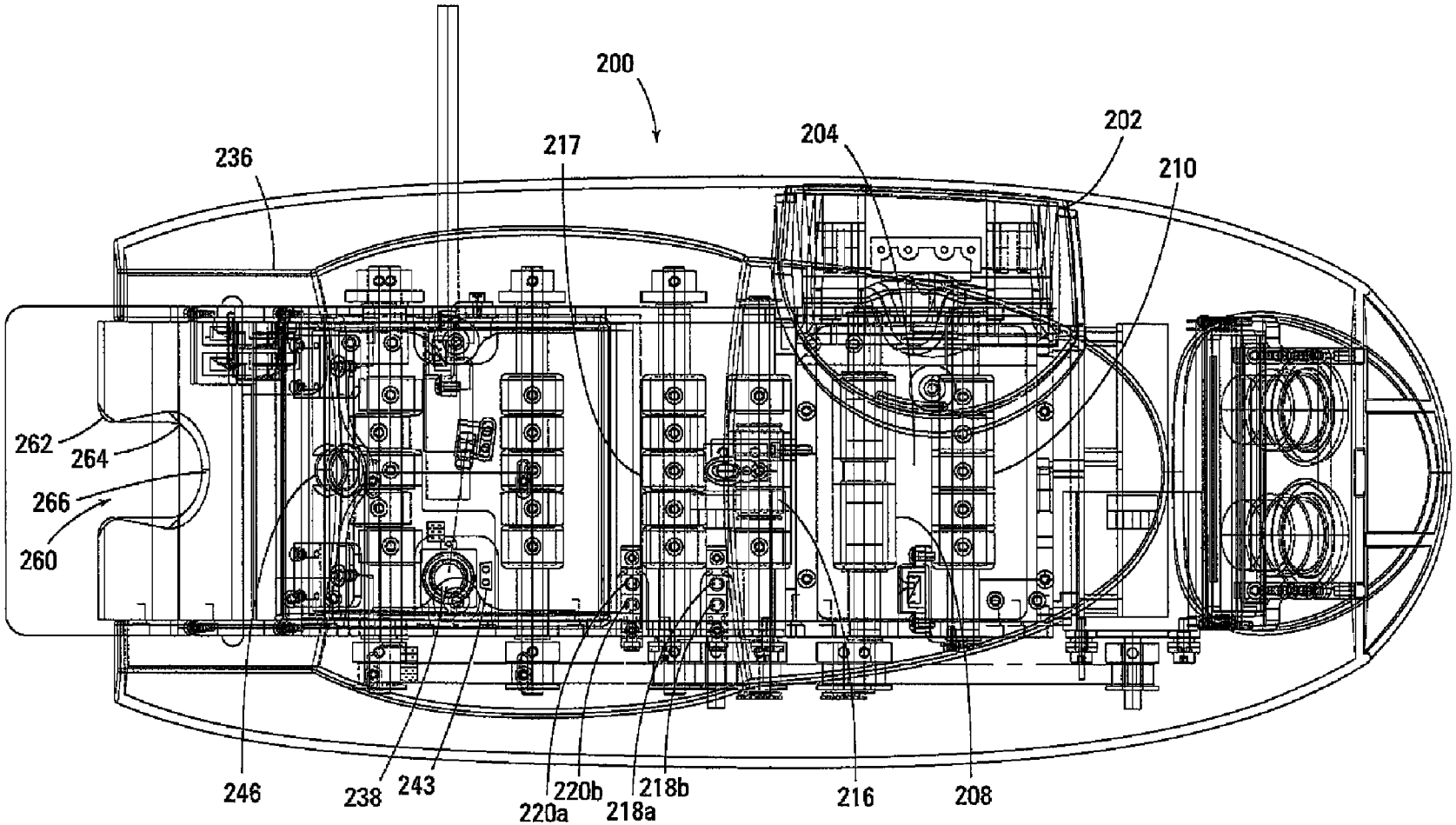
FIG. 4 shows a top cutaway view of one embodiment of a dealing shoe of an embodiment of the present invention.

FIG. 4 shows a top cutaway view of the dealing shoe 200 of an embodiment of the present invention. A flip up door 202 allows cards to be manually inserted into the card input area 204. The sets of pick-off rollers 208 and 210 are shown in the card input area 204. The position of the sensors 218*a*, 218*b* and 220*a*, 220*b* are shown outwardly from the sets of five brake rollers 216 and five speed up rollers 217. The sensors are shown in sets of two sensors, which is an optional construction, and single sensors may be used. The dual set of sensors (as in sensors 220*a* and 220*b*) are provided with the outermost sensor 220*b* providing simply sensing card presence ability and the innermost sensor 220*a* reads the presence of card to trigger the operation of the camera card reading sensor 238 that reads at least value, and optionally rank, and suit of cards. Alternatively, the sensor 220*a* may be a single sensor used as a trigger to time the image sensing or card reading performed by camera card reading sensor 238, as well as sensing the presence of a card. An LED light panel 243 or other light providing system is shown, present as a clearly optional feature. A sensor 246 at the card removal end 236 of the shoe 200 is provided. The finger slot 260 is shown at the card delivery area 236 of the shoe 200. The lowest portion 262 of the finger slot 260 is narrower than the top portion 264 of the finger slot 260. Walls 266 may also be sloped inwardly toward the shoe 200 and outwardly toward the opening 260 to provide an ergonomic feature to the finger slot 260.

The term "camera" is intended to have its broadest meaning to include any component that accepts radiation (including visible radiation, infrared, near ultraviolet, ultraviolet, etc.) and provides a signal based on variations of the radiation received. This can be an analog camera with a decoder or a digital camera or receiver that converts the received radiation into signals that can be analyzed with respect to image content. The signals may reflect either color or black-and-white information or merely measure shifts in color density and pattern. Area detectors, semiconductor converters, optical fiber transmitters to sensors or the like may be used. Any convenient software may be used that can convert to radiation signals to information that can identify the suit/rank of a card from the received signal. The term "camera" is not intended to be limited in the underlying nature of its function. Lenses may or may not be needed to focus light; mirrors may or may not be needed to direct light; and additional radiation emitters (lights, bulbs, etc.) may or may not be needed to assure sufficient radiation intensity for imaging by the camera.

There are a number of independent and/or alternative characteristics of the delivery shoe that are believed to be unique in a device that does not shuffle, sort, order or randomize playing cards.

1) Shuffled cards are inserted into the shoe for dealing and are mechanically moved through the shoe but not necessarily mechanically removed from the shoe.
2) The shoe may optionally mechanically feed the cards (one at a time) to a buffer area where one, two or more cards may be stored after removal from a card input area (before or after reading of the cards) and before delivery to a dealer accessible opening from which cards may be manually removed.
3) An intermediate number of cards are positioned in a buffer zone between the input area and the removal area to increase the overall speed of card feeding with rank and/or suit reading and/or scanning to the dealer.
4) Sensors indicate when the dealer accessible card delivery area is empty and cards are automatically fed from the buffer zone (and read then or earlier) one at a time.
5) Cards are fed into the dealer shoe as a vertical stack of face-down cards, mechanically transmitted approximately horizontally, read, and driven into a delivery area where cards can be manually removed.
6) Sensors detect when a card has been moved into a card reading area. Signal sensors can be used to activate the card reading components (e.g., the camera and even associated lights) so that the normal symbols on the card can be accurately read.

With regard to triggering of the camera, a triggering mechanism can be used to set off the camera shot at an appropriate time when the card face is expected to be in the camera focal area. Such triggers can include one or more of the following, such as optical position sensors within an initial card set receiving area, an optical sensor, a nip pressure sensor (not specifically shown, but which could be within either nip roller (e.g., 16 or 17), and the like. When one of these triggers is activated, the camera is instructed to time its shot to the time when the symbol containing corner of the card is expected to be positioned within the camera focal area. The card may be moving at this time and does not have to be stopped. The underlying function is to have some triggering in the device that will indicate with a sufficient degree of certainty when the symbol portion of a moving or moved card will be within the camera focal area. A light associated with the camera may also be triggered in tandem with the camera so as to extend the life of the light and reduce energy expenditure in the system. Non-triggering cameras, such as a streaming video camera, could also be used.

The system of the present invention is intended to increase dealer accuracy in providing the dealer with instructions on applying the rules of Baccarat (i.e., when to give hit cards) and paying off hands and also prevents player cheating and identifies player-dealer collusion. When combined with other table monitoring systems, the information gained can be even more valuable. For example, casinos wish to understand the play and wagering traits of their customers. Some casinos have employees visually observe the customer's game play, manually tracking the gaming and wagering habits of the particular customers. The information allows the casinos to select the number of different games that the casino will provide and to adequately staff those games. The information also allows the casinos to select certain customers to receive complimentary benefits ("comps") and to determine the amount of comps a particular customer is to receive. The act of giving comps to a customer produces a large amount of goodwill with the customers, encouraging customer loyalty and further wagering. Some casinos have attempted to partially automate the tracking process, reading a customer "comp" card to identify the customer. The actual gaming and wagering patterns of the customers are visually observed by casino personnel and manually entered into a computer to create a digitized copy of the customer's gaming habits.

Similarly, casinos wish to track the efficiency of the casino and the casino's employees, as well as track betting and winning tendencies of individual players to avoid card counters or other play strategies that casinos consider to be undesirable. Such information allows the casino to make changes to identified situations and to increase the overall efficiency of the casino and of the employees, benefiting both the casino and customers. A typical method of tracking employee efficiency is to manually count the number of hands of blackjack dealt by a dealer over some time period. A change in an amount in a bank at the gaming table can also be manually determined and combined with the count of the number of hands to determine a won/loss percentage for the dealer. The casino can use the information to take appropriate action, such as rewarding an efficient dealer, or providing additional training to an inefficient dealer.

The fast pace and large sums of money make casinos regular targets for fraud, cheating and stealing. Casinos employ a variety of security measures to discourage cheating or stealing by both customers and employees. For example, surveillance cameras covering a gaming area or particular gaming table provide a live or taped video signal that security personnel can closely examine. Additionally, or alternatively, "pit managers" can visually monitor the live play of a game at the gaming table. The ability to track cards, track card play, track cards between a shuffling step (where the order of cards is identified by the shuffler through a reading function) and the dealing step (by reading cards in the dealing shoe) adds a further level of security to the casino and provides a clear basis of data for analysis by a central computer.

While some aspects of a casino's security system should be plainly visible as a deterrent, other aspects of the security should be unobtrusive to avoid detracting from the players' enjoyment of the game and to prevent cheaters and thieves from avoiding detection. The ability of a dealing shoe to read cards outside the view of players is a benefit to the secure environment without increasing the negative effects of players repeatedly seeing security devices.

The delivery shoe, its methods and apparatus may be generally defined as card delivery shoe having a storage end and a delivery end. The shoe stores a first set of cards in the storage end and allows manual removal of cards from the delivery end. There may be at least one first sensor in the delivery end that senses when a card is absent from the delivery end. The sensor provides a signal (to some intelligence or signal receiving function) and a signal or power is provided to a motor so that a card is delivered to the delivery end. A motor mechanically delivers a card to the delivery end of the shoe as a result of the initial sensing of the absence of any card from the delivery end, especially where the card may be manually removed from the delivery end. The card delivery shoe may also have at least one sensor that reads card values in the card delivery shoe before a card that is read is stationary in the card delivery end.

An alternative way of describing other embodiments of the delivery shoe include a description as a playing card delivery shoe from which cards may be dealt comprising a) an area for receiving a first set of cards;

b) a first card mover that moves cards from the first set to a card staging area, wherein at least one card is staged in an order by which cards are removed from the first set of and moved to the card staging area;

c) a second card mover that moves cards from the card staging area to a delivery area, wherein cards removed from the staging area to the delivery shoe are moved in the same order by which cards were removed from the first set of cards and moved to the card staging area; and d) card reading sensors that read at least one element of information of card rank, card suit or card value of each card separately after each card has been removed from the area for receiving the first set of cards and before removal from the card delivery area.

The shoe may optionally have a maximum capacity of at least one card but less than an entire deck of cards present in the staging area. Preferably, from one to two cards are present in the staging area, most preferably only one card is present. After completion of card reading of at least one card in step d), a system of comparison may be present to compare the suit and rank of the at least one card to expected card information. The expected card information may be present in a memory storage component in the shoe or external computer for each shuffled set of cards inserted in the area for receiving a shuffled set of cards. The memory storage area may also be in a central computer and read information from the shoe is relayed to the central computer for comparison. The system of comparison may be present to compare the suit and rank of the cards read in step d) with the expected card information for each shuffled set of cards inserted in the area for receiving a shuffled set of cards. The at least one information is read by the device before the card is being removed from the storage device. Preferably, the first set of cards comprises a shuffled set of cards.

Certain aspects of the invention may alternatively be described as a card storage shoe comprising a card infeed area where an approximately vertical set of cards can be seated. The shoe could have a card moving element that moves one card at a time from the approximately vertical set of cards. There could be an automatic mechanical transporting system for horizontally transporting individual ones of cards moved from the vertical set of cards to a card delivery area. There is preferably (but optionally) a card reading system that reads at least one of suit, rank and value of cards before read cards become stationary in the card delivery area. In one embodiment, a buffer area is present between the card infeed area and the card delivery area and at least some cards remain stationary for a time in the buffer area before being delivered to the card delivery area. Cards may be read, for example, entering or while stationary in the buffer area. It is one embodiment to have only one card present in the card buffer area at any time. It is one aspect of an embodiment of the invention for cards to be read in the shoe after they leave the card buffer area but before they are completely stationary in the card delivery area. They may be read when stationary in the card buffer area, but not in the card delivery area. There may be more than one sensor present along a path between the card infeed area and the card delivery area to detect the presence of cards at specific locations.

There may be design and function reasons in certain embodiments to have a sensor-reader (e.g., a camera or any other form of image detector) read cards discontinuously when the sensor-reader is triggered by a card detection sensor in the shoe.

A method is available for providing a card to a dealer for manual delivery of the cards by a dealer, the method comprising:

placing a set of cards within a card infeed area;

mechanically moving cards from the set of cards from the card infeed area to a card delivery area where at least some cards become stationary;

reading individual cards for at least one of rank, suit or value after the cards are removed from the card infeed area and before the cards become stationary in the card delivery area.

The method may have the set of cards is placed in an approximately vertical stack in the card infeed area. At least one card from the set of cards may be moved to a buffer area between the infeed area and the card delivery area, and at least one card may remain stationary within the buffer area until the card delivery area is sensed to be empty of cards. The at least one card that remains stationary in a buffer area may remain in the buffer area until a signal generated from the shoe indicates that at least one card is to be moved from the buffer area to the card delivery area. The method may be generated by a sensor in the card delivery area indicating that an additional card is desired in the card delivery area. The signal may be generated by a sensor in the card delivery area indicating that no cards are present in the card delivery area.

The above structures, materials and physical arrangements are exemplary and are not intended to be limiting. Angles and positions in the displayed designs and figures may be varied according to the design and skill of the artisan. Travel paths of the cards need not be precisely horizontal from the card input area to the delivery area of the shoe, but may be slightly angled upwardly, downwardly or varied across the path from the card input area to the card delivery area. The cards may be sensed and/or read within the shoe while they are moving or when they are still at a particular location within the shoe.

The shoe for use with the Baccarat game may be integrated with other components, subcomponents and systems that exist on casino tables for use with casino table games and card games. Such elements as bet sensors, progressive jackpot meters, play analysis systems, wagering analysis systems, player comping systems, player movement analysis systems, security systems, round counting systems and the like may be provided in combination with the Baccarat shoe and system described herein. Newer formats for providing the electronics and components may be combined with the Baccarat system. For example, new electronic systems used on tables that provide localized intelligence to enable local components to function without absolute command by a central computer are desirable.

A concept of operative control among processing units should be appreciated to appreciate the performance of the present invention as well as to comprehend differences between the practice of the present invention and conventional processing apparatus used in the gaming industry. The most important concept is that all existing systems control all functions on the table using a single main processor. For purposes of discussion, the initial main emphasis of the description will be directed toward the performance of a casino table card game gaming apparatus. This emphasis is not intended to narrow the scope of the invention, but is rather intended to simplify the description.

In a standard slot-type gaming apparatus, different events are sensed and provide information. The central processor evaluates this information and commands another element to perform a procedure or initiate a sequential event. For example, a coin is deposited in the coin receptor, the coin is sensed in the coin acceptor and a signal is sent to the main processor that a coin has been received. The main processor receives this information and sends a signal to the credit display to indicate that one credit should be displayed. An additional signal is sent to the button panel that activates the game initiation (Start) button that enables a player to press the Start button to enable a game to begin. Prior to this command from the main processor, the Start button was inactive. When a second coin is inserted, the same event happens between the coin acceptor, the processor and the credit display, with the command now being to display two available credits. The processor knows not to send a separate activation notice to the Start button. When the player presses the credit use button (e.g., Bet Maximum Credits, Bet One Credit, etc.), a signal is sent to the game control function within the main processor to register the amount of the wager. The main processor then demands that the video display show the number of credits wagered. When the Start button is pressed, a signal is sent to the main processor that then sends a signal to the game processor to initiate play of a game. Signals are sent from the main processor to the video screen and the random number generator to perform the tasks necessary to effect a play event. The random number generator provides the results to or within the main processor and the main processor identifies the symbols to be displayed on the video screen and determine the existence of the status of the wager (win, lose or draw). In the event that the processor determines that a winning event has occurred, the processor then signals the credit display to indicate the total amount of credits won and commands the screen to display any winning alerts and the like.

As can be seen from this analysis, the individual peripherals send signals to the main processor and the main processor provides specific commands to the various peripherals that specific functions are to be performed. There are a couple of concepts that are important to consider in this performance. First, a fairly sophisticated and powerful processor is needed to control all of the peripherals, such as a PC grade processor. Second, the processor must order events to send out separate signals to each of the peripherals, slowing down game performance. As can be seen from these disclosures, the computing structural and component structures of gaming systems follows the traditional format of a main processor driving peripherals, and where one feature demands a significant amount of computing power, more processors may be added, with one still tending to be the dominant main processor sending commands to the peripherals.

The systems in live gaming table systems tend to be structured in the same manner as the slave master-formats of slot machine devices, with systems described as comprising a main computer, central computer or the like, and various peripherals such as card readers, chip readers, cameras, lighting elements, shufflers, bet sensors, movement sensors, motion sensors, jackpot incrementers/decrementers, game status indicators (e.g., jackpot registers, blackjack indicators, symbol indicators and the like) and any other elements of the table game.

As can be seen, even where there is some processing intelligence distributed around a gaming table, the underlying operation of the system remains a command and response structure, which both requires high component costs and limits the operation of the system. A gaming system with different architectural structure would be desirable if it could reduce costs and add flexibility to the system and enable ease of component replacement.

Multiple intelligent data collection modules, each acting as a finite state machine, are communicatively interconnected with a sensing device to collect data, date stamp the data and send it to a central data repository via a network. The processing unit, referred to in this application as a "G-Mod" in one example of the invention, is a microprocessor with associated memory that is capable of being programmed. In another form, the G-Mod is a hard wired as a FPGA (field programmable gate array). The G-Mod performs data acquisition, date stamps and sends sensed data via a network such as an Ethernet to an external computer that contains a database. In contrast to systems that provide an exclusive main computer to command all or most individual sensors and peripherals, in the presently described technology, the G-Mods detect activity in the sensors and peripherals. The G-Mods date stamp and broadcast the information over an Ethernet to a central database. One preferred mode of communication is UDP, but others, such as TCP and TCPIP, are alternative communication protocols. In a preferred form of the invention, the G-Mods broadcast information over a network but do not cause other G-Mods to perform operations. Less powerful techniques (as compared to typical main processor systems used in gaming apparatus) may be distributed to monitor each peripheral. The use of these separate intelligences for each peripheral eliminates the need to reprogram old modules as new modules are added, and allows the manufacturer to offer customized hardware and software packages capable of collecting only the information that the casino operator wants to collect.

A G-Mod could be used in place of the mini-PC of one example of the invention to identify card rank and display hit and hand resolution rules. Or, the G-Mod corresponding to the Baccarat shoe could instead just date/time stamp the data and send the data in real time to a database.

Casino table card games can be provided with a wide variety of sensors. One such sensor is for detection of an indicator initiated by a dealer to indicate approximate beginning or final completion of a round of play of a casino table card game. The sensor is read by the distributed intelligence table subcomponent (a G-Mod) that has a time/dating capability. The signal is time/date stamped, referred to herein as "date stamping" for simplicity. The date-stamped data is then transmitted generally through a communication line to an external computer that contains database management software and a database interface. The data can be accessed by programs used to analyze the data, if needed. The database interface allows casino management to extract the data in a usable form. The collected data retains its date stamping at least through storage, analysis, data entry or other treatment of the data after transmission away from the table, and the date stamping is typically provided by the separate intelligence, although in some cases, may or may not be provided by the sensor itself.

The components of a casino table gaming apparatus might include a coin acceptor, bill validator, a drop box capable of sensing the input of currency, ticket in/ticket out sensing/reading, lighting, video displays, card reading sensors, chip counters, security sensing, dealer input controls, player input controls, dealer identification card scanning, player tracking, round counting, hand counting, shuffle counting and the like. In the present technology described herein, a round counting system is also described, wherein the number of rounds of plays are determined (one round at a time) by a determination of when a dealer's play has been completed, as by complete removal of cards from the dealer's position.

In the practice of the present invention, communication to a data collection system with at least some peripherals is performed by general broadcast communication of game status (which may also be referred to as generated information or data) over a table-specific network, from more than one distributed intelligence source within the system, each of which is associated with at least one peripheral. Each distributed intelligence (a local processor) sends its own game status communication over the network, but does not respond to game status information of other G-Mods. Each local processor (hereinafter "G-Mod") is capable of sending date-stamped information to a database where the information is stored and can be accessed by the same computer that holds the database or by another external computer. This is a significant element in the practice of the invention, that information may be generally sent (essentially at the same time as a single, generally dispersed signal) over a network from multiple distributed intelligences.

For example, in the description given above for the insertion of a coin into the coin acceptor, when a coin is inserted in the system of the invention, the data is time stamped and sent via an Ethernet network to a database collection system. As other G-Mod monitored activities occur, additional information is transmitted to the data collection system, independent of when/where other data is being collected and transmitted.

In one form of the invention, the state of each G-Mod is broadcast over a network that contains all of the sensors and G-Mods associated with one gaming table. One G-Mod could control the operation of the card reading shoe, for example. As the state of each G-Mod changes, the signals being broadcast to all of the G-Mods is changed, and each G-Mod independently transmits information to the central data collection point.

One conceptual way of visualizing or understanding a method of implementing an intelligence system for the operation of a gaming system according to the present invention is as decomposing the tasks of previous constrained (central processor commanded) systems into orthogonal or unrelated sensing events running on independent processors. The term "orthogonal" for purposes of this disclosure means no commonality in function. The provision of orthogonal or independent intelligence functionality and individual performance capability allows the various system components to operate independently and timely transfer the date-stamped data to a database for further processing. Such a system functions more efficiently because there is no central processor prioritizing the execution of functions.

As noted above, there are many different elements of the gaming system that can be considered as peripherals. Some more important examples of table-game related peripherals include: bet presence, bet recognition, bet separation, card identification, card tracking, player tracking and employee tracking. Other components might include (in addition to those described above) multimedia processing, stepper motor control, random number generation, I/O detection and response, audio signals, video signals, currency handling, coin acceptors, bill acceptors, paperless transactions, ticket-in and ticket-out crediting, security systems, player accounting functions, door locks, signal lighting (change/assistance), player input (e.g., button controls, joy sticks, touch screens, etc.) and any other functions that may be provided on the gaming apparatus.

The units (which may be elsewhere referred to herein as gaming modules or G-Mods) are operated substantially independently of each other, although some interdependencies could exist. In the event of interdependencies, they are not subject to the classic control model but operate by finite state machine changes that are broadcast and then react with intelligence. For purposes of this disclosure, the term "finite state machine" (or FSM) is a theoretical device used to describe the evolution of an object's condition based on its current state (or condition) and outside influences. The present state of an object, its history, and the forces acting upon it can be analyzed to determine the future state of an object. Each state then may have a "behavior" associated with it. An FSM is a very efficient way to model sequencing circuits. Ultimately, the game is nothing more than a complex sequencing unit, branched as appropriate for the game function. All finite state machines can be implemented as hardware, or as software running on a processor or combinations of the two.

By assigning specific data collection controls to local architecture, the design of the system places system tasks into lower computing power manageable units. The manageable units (e.g., the peripherals) can then be each handled (or small groups handled) by dedicated controller modules. Some design care should be taken to combine control of peripherals under a single intelligence to assure that such accumulating demands for processing power are not being required as to merely reconstruct a main processor in a different physical location with the system. For example, it might be desirable to combine the tower light (change/assistance) command control intelligence with other button control signals, even though the result is not a game play function. The intelligence requirement for such an assistance function is so low that its addition to almost any other function would be barely noticed. In the distributed intelligence structure, the G-Modules or individual intelligences have enough intelligence on board to handle the details of how the G-Mod itself handles the details of operation of the peripheral device.

Although a round-counting module that sends date-stamped information to a central database can be used in combination with the Baccarat monitoring system of the present invention, it is to be understood that multiple modules could be combined with the present system to send collected data to a data repository. In a preferred form of the invention, the date-stamped data is broadcast over an Ethernet specific to the table game, and that the data in this format is collected and recorded by the central data repository.

For example, a Baccarat gaming table that is equipped with a round counting sensor and G-Mod may also be equipped with a sensor at the output of the dealing shoe for counting cards dispensed from the shoe. This information can be used in combination with the round counting information to deduce the number of cards dealt in a given round of play. If there are bet present sensors (and associated G-Mod(s)) for the bet sensors, the number of hands played per round of play can be determined. The modules may communicate with one another to send date-stamped bundles of information to the database, or may allow one module to influence the operation of another module.

Each G-Mod is collecting, date stamping and transmitting data as the data is collected from the table to a central database, but the G-Mods are not influencing the operation of one another. The database does not issue commands to the G-Mods, except to reset, reboot and send and receive configuration information. In effect, each G-Mod is a freestanding microprocessor that runs independently of any other intelligence, except that it receives limited operational information from the database computer.

A card swipe module could be added to the table system, with an associated G-Mod. This G-Mod could not only transmit time-stamped data to the data repository, but could also transmit player and/or dealer I.D. information to the player tracking system residing in the casino computer system.

One or more sensors could sense information transmitted through an output data port of a shuffler, for example, or a keypad control used to issue commands to a shuffler. The shuffler would have its own G-Mod and is capable of transmitting date-stamped information such as number of cards per hand, number of hands per hour, number of cards dispensed per unit time, number of cards re-fed into a continuous shuffler per unit of time, number of promotional cards dispensed per unit of time, etc. At the same time, another indicator attached to a G-Mod could transmit data-stamped data about bonus awards granted at a certain time, and the like. This information could be collected in a central database.

A bet interface module could also be provided. Known collection techniques for wagering data include optical and metal detection type bet present sensors for fixed bets, and camera imaging, radio frequency/identification technology, bar code scanning, scene digitizing, laser scanning, magnetic strip reading and the like for measuring the amount of the bet, as well as the presence of the bet. Outputs from these measurement devices are fed through a dedicated G-Mod and the data is date stamped and delivered to the central data depository.

Another possible G-Mod controls a card reading camera or other sensing device with similar functionality (reading rank and suit of a card, or just rank) located in the card shuffler, the dealing shoe, the discard tray, above the table or combinations of the above. Information about the specific cards dealt to each player could be obtained from the database by first feeding date-stamped information about cards dealt and returned into the database via the Ethernet.

In one form of the invention, the G-Mod sends date-stamped information to the database and an algorithm residing in the same computer or separate computer uses this information as well as round counting and betting information to determine the composition of a hand of blackjack, for example.

Another G-Mod is in communication with an i.d. system for tracking the movement of employees in and out of the pit, or more preferably, when the dealers arrive at and leave the table. This information is collected and reported by the dealer G-Mod into the database, and then reports can be generated that combine this information with rounds of play per hour to determine which dealers deal the most hands in a given period of time.

It is noteworthy that in a preferred form of the invention, all of the G-Mods are in communication with the same database, although separate databases may be established for distinct data sets. Also, data repository does not issue commands to the G-Mods, with the exception of requesting configuration data and resetting/rebooting the G-Mods. The central database merely organizes the data in a manner that allows for easy access by external computers or another application program residing on the same computer as the database. In this respect, the G-Mods are self-executing and do not require central intelligence to perform their individual functions. The data may be analyzed and used to make decisions about awarding redeemable points and free rooms to players, etc., scheduling pit labor, promoting pit personnel, closing and opening tables, determining optimal betting limits for given periods of time and other important managerial functions.

Each G-Mod may be in data communication with an interface device such as one or more specialized circuit boards to allow the data from multiple G-Mods to be fed into a standard port of the computer that serves as the data repository. Also, multiple sensing modules may be fed into a single G-Mod if the particular G-Mod has the capacity to process the extra information.

A software interface can be provided to directly access data in the data repository and to manipulate and organize the data so that it can be outputted onto a display, written report or formed into a data stream so that the data can be further manipulated. In one example of a software interface program, the operator can obtain reports of rounds of play per hour per actual table, per pit, or per property, as determined by the user.

The information in the form of a data stream may be further analyzed. In one example, the data is fed into a host computer or can be analyzed in the same computer system where the database and interface resides or on a host computer. For example, the data from one or more of the round counting module, the shoe sensor, the card swipe, card reading module, the shuffler data port sensor, and the bet interfaces can be used to create a report of rounds played per unit of time, the number of players at the table per unit of time, the number of hands played at each round, the maximum bet per player in a given unit of time, the average bet per player in a unit of time, the number of shuffles per unit of time, the number of cards removed from and placed into the shuffler in a unit of time, hand composition and other information considered important to the casino manager.

Because all of the G-Mods work independently, the casino operator can choose the modules and resulting data that is most important to them for a given environment, and only purchase those modules. For example, one casino might want to reconstruct individual hands, track betting and associate the information with a particular player on a high stakes table, while tracking only rounds and the identification of the employees on low stakes games.

By using a modular approach to intelligent data collection, only the equipment and reports that are wanted can be provided at the lowest possible cost. Since none of the G-Mods are issuing direct commands to one another, it is not necessary to rewrite any code when additional modules are added.

Applicants have discovered that there are potential inaccuracies in data that is transmitted prior to date/time stamping. When signals are stamped in by the main computer, this is merely indicative of when the signal arrived. Also, by providing the stamping function at the receipt site (such as the main processor or central gaming location), the information is more easily subject to manipulation or change by an operator. In addition, when there is a line breakdown (e.g., some casinos may still use telephone line connections that can be busy or interrupted, or the communication system to the main computer breaks down), the accuracy of the stamping is adversely affected. The value of the data decreases in some necessary transactions and casino oversight if the time data is inaccurate. A gaming system with different architectural structure and informational structure would be desirable if it could reduce these issues.

There are many different elements of the gaming system that can be considered as peripherals. Some more important examples of table game-related peripherals include: bet presence, bet recognition, bet separation, card identification, card tracking, player tracking and employee tracking. Another listing of these components would include (in addition to those described above) multimedia processing, stepper motor control, random number generation, card reading, hand reading (ranking), player strategy review/analysis, I/O detection and response, audio signals, video signals, currency handling, coin acceptors, bill acceptors, paperless transactions, ticket-in and ticket-out crediting, security systems, player accounting functions, door locks, player input (e.g., button controls, joy sticks, touch screens, service calls, etc.) and any other functions that may be provided on the table gaming apparatus.

As noted earlier, round counting is one service or data component that can be important to a table. For example, round completion can be important for evaluating rates of play at tables, player rate performance, dealer rate performance, and even disputes over time of completion of hands at different tables or different casinos where priority might be an issue (as in competitive events or qualifying events).

Round counting requires some form of signal generation at a table that is indicative of approximate completion of a round and preferably absolute completion of a round. This can be done in a number of ways for signal generation. For example, video cameras can be placed to observe the dealer's hand. When the motions of a dealer or the dealer's cards indicate that the dealer's cards have been removed from the playing area, a signal is sent "round completed" or "dealer's hand removed" or some functional equivalent. A sensor can be placed on the table over which the dealer's cards are placed. It is preferred that this sensor not be as movement limiting as the sensor in U.S. Pat. No. 5,803,808, where cards appear to have to be specifically fit into at least a right angle abutment with the sensor with card reading ability. Upright extensions on the card table can interfere with card movement, can interfere with chip movement, can cause accidental disclosure of cards, and are generally undesirable. A sensing system with a relatively flat, slightly indented or slightly raised surface is more desirable. The system could comprise a transparent or translucent panel approximately flush with the table surface that allows light (e.g., ambient light or specially directed wavelengths of light for which a sensor is particularly sensitive) to pass to a sensor. The absence of light in the sensor for a predetermined period of time and/or intervals of time can be the original signals themselves, which are interpreted by an intermediary intelligence on the table that has the time sensing capability for evaluating the signal. The original signals are then time stamped before being forwarded to the central database and can be analyzed by accessing the collected data.

Particularly in games where batch shuffling is used, such as poker or even single-deck blackjack, the signal could also be originated by cards being placed in a shuffler and a shuffling process initiated, with the shuffler sending a start-shuffling signal to the date-stamping component on the table. The dealer could even activate or press a button provided on the table, but this would tend to leave the results under the control of the dealer, which could be manipulated by the dealer to improve results on dealer play, or the dealer could suffer from forgetfulness.

These latter systems, unless they are completely electronic without any physical implementation (such as physical playing cards, dice, a spinning wheel, a drop ball, etc.), will need sensing and/or reading equipment (e.g., card reading for suits and/or rank, bet reading sensors, ball position sensors, dice reading sensors, player card readers, dealer input sensors, player input systems, and the like. These would be the peripherals in the table systems. Also, newer capabilities are enabled such as moisture detection (e.g., for spilled drinks), smoke detection, infrared ink detection (to avoid card marking), shuffler operation, dealer shoe operation, discard rack operation, jackpot meters, side bet detectors, and the like.

What is claimed:

1. A playing card delivery shoe for use in the play of the casino table card game of Baccarat, the playing card delivery shoe comprising:

a) a first area for receiving a first set of playing cards useful in the play of the casino table card game of Baccarat;

b) a playing card delivery area for manual removal of individual cards;

c) at least one playing card mover to move playing cards from the first area to the playing card delivery area;

d) at least one playing card reading sensor to read at least one playing card value of each playing card separately after each playing card has been moved from the first area and before manual removal from the playing card delivery area;

e) a processor for controlling operation of the at least one playing card mover;

wherein there is a communication link between the at least one playing card reading sensor and a processor programmed to analyze data comprising the at least one playing card value read from each playing card according to rules of play of the game of Baccarat and to determine results of play for a round of play of Baccarat based upon the data; and wherein the processor is further programmed to detect failed elements within the playing card delivery shoe and generate a signal in response to a failed element detection.

2. The playing card delivery shoe of claim 1, wherein the first area comprises an area of a size suitable to retain up to eight decks of cards.

3. The playing card delivery shoe of claim 2, wherein the first area comprises a lower sloping surface.

4. The playing card delivery shoe of claim 1, further comprising a display, wherein the generated signal causes an indication of a failed element to be displayed on the display.

5. The playing card delivery shoe of claim 4, wherein the display is mounted to a surface of the shoe.

6. The playing card delivery shoe of claim 1, wherein the processor communicable with the at least one playing card reading sensor is internal to the shoe.

7. The playing card delivery shoe of claim 1, wherein the processor communicable with the at least one playing card reading sensor is external to the shoe.

* * * * *